US009183821B2

(12) United States Patent
Matusiak

(10) Patent No.: US 9,183,821 B2
(45) Date of Patent: Nov. 10, 2015

(54) SYSTEM AND METHOD FOR ANALYSIS AND CREATION OF MUSIC

(71) Applicant: Exomens Ltd., York (GB)

(72) Inventor: Marcus A. Matusiak, Clifton (GB)

(73) Assignee: EXOMENS, North Yorkshire (GB)

( * ) Notice: Subject to any disclaimer, the term of this patent is extended or adjusted under 35 U.S.C. 154(b) by 63 days.

(21) Appl. No.: 14/197,316

(22) Filed: Mar. 5, 2014

(65) Prior Publication Data

US 2014/0260913 A1 Sep. 18, 2014

Related U.S. Application Data

(63) Continuation of application No. 13/843,679, filed on Mar. 15, 2013, now Pat. No. 8,927,846.

(51) Int. Cl.
*G10H 1/38* (2006.01)
*G10H 1/00* (2006.01)

(52) U.S. Cl.
CPC ..... *G10H 1/383* (2013.01); *G10H 1/0025* (2013.01); *G10H 1/38* (2013.01)

(58) Field of Classification Search
CPC ..... G10H 2210/066; G10H 1/40; G10H 2210/081; G10H 1/38; G10H 2240/131; G10H 3/125; G10H 2240/325; G10H 2210/061; G10H 1/383; G10H 2210/056; G10H 2210/031; G10H 2210/071; G10H 2210/571; G10H 2210/335; G10K 15/02; G10G 1/02
See application file for complete search history.

(56) References Cited

U.S. PATENT DOCUMENTS

| | | | | |
|---|---|---|---|---|
| 6,323,412 | B1 * | 11/2001 | Loo | 84/636 |
| 8,168,877 | B1 * | 5/2012 | Rutledge et al. | 84/613 |
| 2005/0211072 | A1 * | 9/2005 | Lu et al. | 84/612 |
| 2005/0247185 | A1 * | 11/2005 | Uhle | 84/616 |
| 2006/0075881 | A1 * | 4/2006 | Streitenberger et al. | 84/609 |
| 2006/0075884 | A1 * | 4/2006 | Streitenberger et al. | 84/616 |
| 2007/0289432 | A1 * | 12/2007 | Basu et al. | 84/609 |
| 2008/0040123 | A1 * | 2/2008 | Shishido | 704/503 |
| 2009/0151547 | A1 * | 6/2009 | Kobayashi | 84/613 |
| 2009/0193959 | A1 * | 8/2009 | Mestres et al. | 84/609 |
| 2009/0205483 | A1 * | 8/2009 | Kim | 84/622 |
| 2009/0282966 | A1 * | 11/2009 | Walker et al. | 84/616 |
| 2009/0306797 | A1 * | 12/2009 | Cox et al. | 700/94 |
| 2011/0112672 | A1 * | 5/2011 | Brown et al. | 700/94 |
| 2011/0268284 | A1 * | 11/2011 | Arimoto et al. | 381/56 |
| 2013/0019738 | A1 * | 1/2013 | Haupt et al. | 84/622 |

(Continued)

*Primary Examiner* — Marlon Fletcher
(74) *Attorney, Agent, or Firm* — Antonio Papageorgiou, Esq.; Meister Seelig & Fein LLP

(57) ABSTRACT

A method and system for analyzing patterns in the relationships of notes of an input piece of music. The method comprises generating a set of the most frequently occurring note pitches in ascending pitch order that matches an interval pattern, and detecting out-of-key pitches that lie outside of this interval pattern. One or more potential key sequence bifurcations are identified which represent a list of possible key sequences according to forwards and backwards analysis. By finding patterns of repetition in the chordal sequences that may be generated according to these key sequence bifurcations, a key sequence that allows the most frequently recurring chord sequences may be chosen. Chord sequences may be analyzed by using ghost chords, temporary harmonic structures that are created, updated and finalized over time according to a combination of essential and inessential note fragments. The method further comprises identifying non-harmony pitches according to the analyzed chord sequence.

15 Claims, 20 Drawing Sheets

(56) References Cited

U.S. PATENT DOCUMENTS

2013/0275421 A1* 10/2013 Resch et al. ..... 707/725
2014/0000441 A1* 1/2014 Miyajima ..... 84/609
2014/0000442 A1* 1/2014 Miyajima ..... 84/609
2014/0174279 A1* 6/2014 Wong et al. ..... 84/609
2014/0260909 A1* 9/2014 Matusiak ..... 84/609

* cited by examiner

| Semitone Number in Comparison to 0 | Number of Keys In Flat Direction Until Pitch Found | Number of Keys In Sharp Direction Until Pitch Found |
|---|---|---|
| 1 | 4 | 2 |
| 3 | 2 | 4 |
| 6 | 5 | 1 |
| 8 | 3 | 3 |
| 10 | 1 | 5 |

| | | | | | | | | |
|---|---|---|---|---|---|---|---|---|
| Chord: | 1 | 5 | 2 | 6 | 1 | 5 | 2 | 1 |
| Key: | 0 | | | | | | 7 | |

Fig. 11

| | | | | | | | | |
|---|---|---|---|---|---|---|---|---|
| Chord: | 1 | 5 | 4 | 5 | 1 | 5 | 4 | 5 |
| Key: | 0 | | | | | 7 | | |

Fig. 12

| | | | | |
|---|---|---|---|---|
| Chord: | A | B | A | B |
| Key: | 0 | | | 7 |

Fig. 13

| | t = 0 | t1 | t2 | t3 | t4 | t5 | t6 |
|---|---|---|---|---|---|---|---|
| Part 1 | **A** | A | **B** | B | B | **C** | C |
| Part 2 | | **A** | A | **B** | B | B | X |
| Part 3 | | | **A** | A | **C** | C | X |

Fig. 14

| | t = 0 | t1 | t2 | t3 | t4 | t5 | t6 |
|---|---|---|---|---|---|---|---|
| Part 1 | **2** | **1** | **B** | B | B | **C** | C |
| Part 2 | | **2** | **1** | **B** | B | B | X |
| Part 3 | | | **2** | **1** | **C** | C | X |

Fig. 15

| | t = 0 | t1 | t2 | t3 | t4 | t5 | t6 |
|---|---|---|---|---|---|---|---|
| Part 1 | **2** | **1** | **3** | **1** | **2** | **C** | C |
| Part 2 | | **2** | **1** | **3** | **1** | **2** | X |
| Part 3 | | | **2** | **1** | **C** | C | X |

Fig. 16

| | t = 0 | t = 1 | t = 3/2 | t = 2 |
|---|---|---|---|---|
| Soprano: | 48(C), 49(C#), 50(D), 51(D#), 52(E), 53(F), 54(F#), 55(G), 56(G#), 57(A), 58(A#), 59(B), 60(C) | 48(C), 49(C#), 50(D), 51(D#), 52(E), 53(F), 54(F#), 55(G), 56(G#), 57(A), 58(A#), 59(B), 60(C) | 48(C), 49(C#), 50(D), 51(D#), 52(E), 53(F), 54(F#), 55(G), 56(G#), 57(A), 58(A#), 59(B), 60(C) | |
| Bass: | 24(C), 25(C#), 26(D), 27(D#), 28(E), 29(F), 30(F#), 31(G), 32(G#), 33(A), 34(A#), 35(B), 36(C) | 24(C), 25(C#), 26(D), 27(D#), 28(E), 29(F), 30(F#), 31(G), 32(G#), 33(A), 34(A#), 35(B), 36(C) | | |

| | t = 0 | t = 1 | t = 3/2 | t = 2 |
|---|---|---|---|---|
| Soprano: | 48(C), 52(E), 55(G), 60(C) | 48(C), 49(C#), 50(D), 51(D#), 52(E), 53(F), 54(F#), 55(G), 56(G#), 57(A), 58(A#), 59(B), 60(C) | 50(D), 55(G), 59(B) | |

Fig. 23

| | t = 0 | t = 1 | t = 2 |
|---|---|---|---|
| Bass: | 24(C), 28(E), 31(G), 36(C) | 26(D), 31(G), 35(B) | |

Fig. 24

| | t = 0 | t = 1 | t = 3/2 | t = 2 |
|---|---|---|---|---|
| Soprano: | 48(C), 52(E), 55(G), 60(C) | 60(C) | 50(D), 55(G), 59(B) | |
| Bass: | 24(C), 28(E), 31(G), 36(C) | 26(D), 31(G), 35(B) | | |

Fig. 25

| | t = 0 | t = 1 | t = 3/2 | t = 2 |
|---|---|---|---|---|
| Soprano: | 60(C) | 60(C) | 59(B) | |
| Bass: | 24(C), 28(E), 31(G), 36(C) | 31(G) | | |

Fig. 26

SYSTEM AND METHOD FOR ANALYSIS AND CREATION OF MUSIC

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

The invention described herein generally relates to analysis of music inputs and music creation based on the analysis.

BACKGROUND OF THE INVENTION

Composing music is the process of putting sounds together in an organized structure. Music composition is regarded by some as an elitist, almost mysterious ability that requires years of training. Both professional and amateur musicians are often interested in expanding and/or improving their respective capabilities in music composition to thereby produce a unique sound, a unique presentation, and/or a unique instrumentation. The accomplishment of this has generally been limited either to a traditional approach employing a musical instrument itself or to utilization of a significantly restricted music-analysis device. Prior art devices do not provide a production of music in accord with the high standards and flexibility sought by musicians.

Existing solutions have remained inadequate, particularly for users who are seeking to produce music in a variety of styles and with a high standard of quality. These solutions typically are either too simple or crude to be useful, or do not offer the user adequate input as to how the music should be composed, both generally, and with regard to how the music may vary within a composition. Additionally, these solutions are one-dimensional, typically taking musical elements and merely connecting them along a timeline. In that sense, there is both a lack of flexibility as to the potential variation within the composed music, as well as a lack of depth in the finished product. There is thus a need automatically compose music that accommodates the creation of musical compositions in any style of music.

SUMMARY OF THE INVENTION

The present invention provides a method and system for analyzing patterns in the relationships of notes of an input piece of music. The method comprises generating a set of the most frequently occurring note pitches in ascending pitch order that matches an interval pattern, and detecting out-of-key pitches that lie outside of this interval pattern. One or more potential key sequence bifurcations are identified which represent a list of possible key sequences according to forwards and backwards analysis. By finding patterns of repetition in the chordal sequences that may be generated according to these key sequence bifurcations, a key sequence that allows the most frequently recurring chord sequences may be chosen. Chord sequences may be analyzed by using ghost chords, temporary harmonic structures that are created, updated and finalized over time according to a combination of essential and inessential note fragments. The method further comprises identifying non-harmony pitches according to the analyzed chord sequence.

The interval pattern represents a scale. Detecting one or more out of key pitches may result in modulation to flatter or sharper keys. In certain embodiments, a flat modulation weight, a sharp modulation weight, a highest change flat, and a highest change sharp for the one or more out of key pitches are determined. For a set of out-of-key pitches, the flat modulation weight is the sum of the least number of keys moved in a flat direction from an original key until each new pitch is found for all pitches in the set, the sharp modulation weight is the sum of the least number of keys moved in a sharp direction from an original key until each new pitch is found for all pitches in the set, the highest change flat is the highest of these key movements in the flat direction, and the highest change sharp is the highest of these key movements in the sharp direction. The method may further include performing a flat modulation for one or more out of key pitches if the flat modulation weight is less than the sharp modulation weight, wherein the amount of keys to move is equal to the highest change flat when modulating in the flat direction, performing a sharp modulation for one or more out of key pitches if the sharp modulation weight is less than the flat modulation weight, wherein the amount of keys to move is equal to highest change sharp when modulating in the sharp direction, and wherein if the flat modulation weight equals the sharp modulation weight, no modulation is performed.

A fragment may be a portion of a note that is chosen to be as long as it can be whilst being bounded by harmonic change. An essential fragment may be a fragment whose pitch value contributes to chordal analysis via ghost chords and an inessential fragment may be a fragment whose pitch is ignored in chordal analysis. An inessential fragment must be bound adjacently to an essential fragment within its line with a pitch difference between the two fragments less than or equal to 2 semitones. In some embodiments, ghost chords may be bounded by an arbitrarily chosen analysis interval which may be, for example, a scalic 5th. Updating a ghost chord may include adding one or more note pitches to the ghost chord provided that there exists a resultant inversion of pitches within the ghost chord that can lie within the related analysis interval.

Determining the desired chord sequence may further include employing a fitness function for evaluation of various combinations of essential and inessential fragment combinations. The fitness function may include at least one or a combination of the following goals: determining a chord sequence that has the lowest triadic chordal numbers possible, determining a chord sequence in which the most note pitches lie, and determining a chord sequence that provides a most tempered harmonic rhythm.

Identifying one or more non-harmony pitches may further include recording a previous scale number in a given line, a current scale number in the given line, a next scale number in the given line, a previous chord, a current chord, a next chord, a previous key, a current key, a next key, and a set of other sounding scalic numbers.

The system comprises a processor, and a memory having executable instructions stored thereon that when executed by the processor cause the processor to generate a set of most frequently occurring note pitches in ascending pitch order that matches an interval pattern and detect pitches that lie outside of this interval pattern. The processor is further configured to identify a plurality of bifurcations from the list of possible key sequences, generate their resultant as well as subsequent chord sequences by detecting essential and inessential note fragments, assign fitness scores to sequences of abstract data according to arbitrary fitness functions and identify non-harmony pitches according to the finalized chord sequence.

BRIEF DESCRIPTION OF THE DRAWINGS

The invention is illustrated in the figures of the accompanying drawings which are meant to be exemplary and not limiting, in which like references are intended to refer to like or corresponding parts, and in which:

FIG. 11 and FIG. 12 illustrate key and chord sequences according to an embodiment of the present invention;

FIG. 13 illustrates a representation of a key sequence and chord frame according to an embodiment of the present invention;

FIG. 14 through FIG. 18 illustrate diagrammatical representations of a part dependent frames for generating a movement pattern sequence according to an embodiment of the present invention;

FIG. 21 through FIG. 26 illustrate chord and harmony reduction of possible pitches within a rhythm structure according to an embodiment of the present invention;

DETAILED DESCRIPTION OF THE INVENTION

Subject matter will now be described more fully hereinafter with reference to the accompanying drawings, which form a part hereof, and which show, by way of illustration, exemplary embodiments in which the invention may be practiced. Subject matter may, however, be embodied in a variety of different forms and, therefore, covered or claimed subject matter is intended to be construed as not being limited to any example embodiments set forth herein; example embodiments are provided merely to be illustrative. It is to be understood that other embodiments may be utilized and structural changes may be made without departing from the scope of the present invention. Likewise, a reasonably broad scope for claimed or covered subject matter is intended. Among other things, for example, subject matter may be embodied as methods, devices, components, or systems. Accordingly, embodiments may, for example, take the form of hardware, software, firmware or any combination thereof (other than software per se). The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

Figure 1:
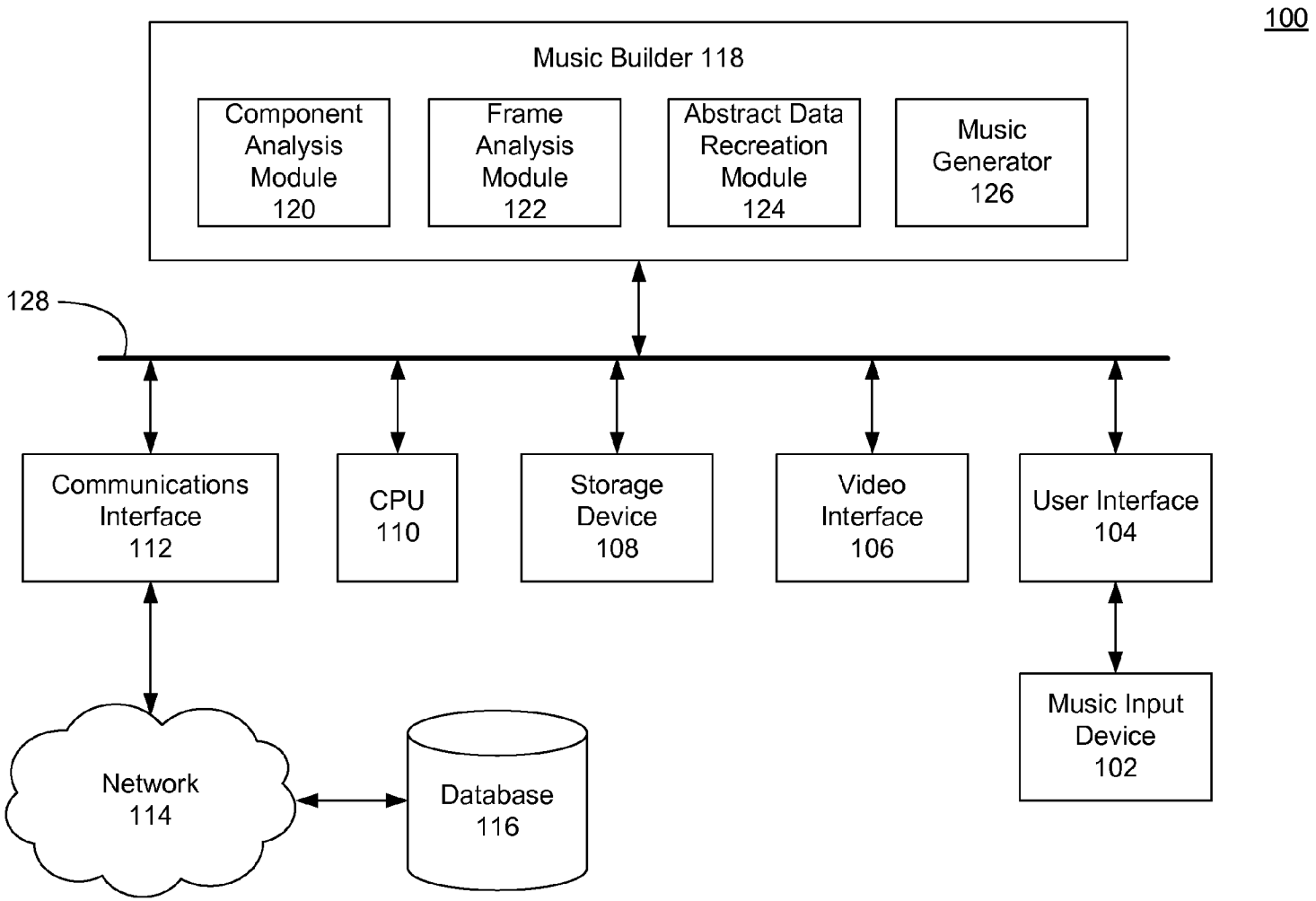
FIG. 1 illustrates a computing system according to an embodiment of the present invention.

FIG. 1 illustrates one embodiment of a system 100 for analyzing and creating music that includes music input device 102, user interface 104, video interface 106, storage device 108, CPU 110, communications interface 112, network 114, database 116, music builder 118, and bus 128. System 100 may comprise a general purpose computing device (e.g., personal computers, mobile devices, terminals, laptops, personal digital assistants (PDA), cell phones, tablet computers, or any computing device having a central processing unit and memory unit capable of connecting to a network. Music input device 102 may include any music equipment, computer, or any other device operable to communicate text, Musical Instrument Digital Interface (MIDI), audio, or any other representation of music to system 100 as musical input. The music input device 102 is communicatively coupled to user interface 104. User interface 104 may include protocols, digital interfaces and connectors to allow for communication between music input devices 102 and system 100 via bus 128. Bus 128 provides a subsystem that transfers data between the various components connected to bus 128 within system 100. Video interface 106 may also comprise a graphical user interface (GUI) or a browser application provided on a display (e.g., monitor screen, LCD or LED display, projector, etc.). Storage device 108 may store the musical input received from music input device 102, information related to the musical input, analysis data from music builder 118, and one or more application programs executed by CPU 110. CPU 110 executes various processing operations such as those associated with music builder 118.

Music builder 118 is configured to analyze musical input from music files on storage device 108 and composes new or original music based on the musical input. According to other embodiments music builder 118 may also be configured to analyze musical input received from music input device 102 as well as music files stored on a database 116. The music builder 118 includes component analysis module 120, frame analysis module 122, abstract data recreation module 124, and music generator 126. Analysis module 120 may prepare music for analysis, and perform various analyses such as vertical analysis, horizontal analysis, and other analyses, which are later described herein in greater detail. Frame analysis module 122 may perform additional analysis in the context of music frames and blocks ("frame analysis"). A frame is a term that may be used to describe the framework of repetition of a particular musical structure. The term "block" may be used to describe a portion of a sequence of abstract data that can be arranged in a musical structure frame. Some examples of abstract data used are keys, chords, rhythm, movement patterns and harmony. Recreation module 124 may create new sequences of abstract data from the frame analysis, which are used by music generator 126 to compose new music. Abstract data may refer to data representative of keys, chords, etc. The music builder may analyze each aspect of one or more musical input, and create frames and blocks of musical data that can be stored in database 116.

Communications interface 112 may include circuitry (e.g., a network adapter) configured to allow communications and transfer of data between system 100 and database 116 via network 114. Network 114 may be any suitable type of network allowing transport of data communications across thereof. In one embodiment, the network may be the Internet, following known Internet protocols for data communication, or any other communication network, e.g., any local area network (LAN), or wide area network (WAN) connection. Database 116 may comprise a collection of data or a store of information associated with data blocks produced by music builder 118. Database 116 may also store the original input pieces as well as any new music that has been generated by music builder 118.

Musical input analyzed by music builder 118 can be used to develop a musical style of composition for a given user. Compositional styles are able to be mixed and matched, and due to the many different aspects of musical analysis, one or more factors may be changed. For example, a user of the system may choose to keep some elements of a "renaissance" style but use "baroque" chord blocks or a "rock" structure with "baroque" linear movement patterns. Imagining two extremes of the spectrum of musical composition, at one end a random selection of notes may occur based on no experience or organized structure and at the other end, an exact repetition of a previously encountered piece may be present. In much the same way as a real composer would use experience of hearing many pieces to intuitively write commonly occurring aspects of music, the music builder 118 can be used to find a middle ground in this spectrum, using experience based in repetition to guide it to its final output.

Figure 2:
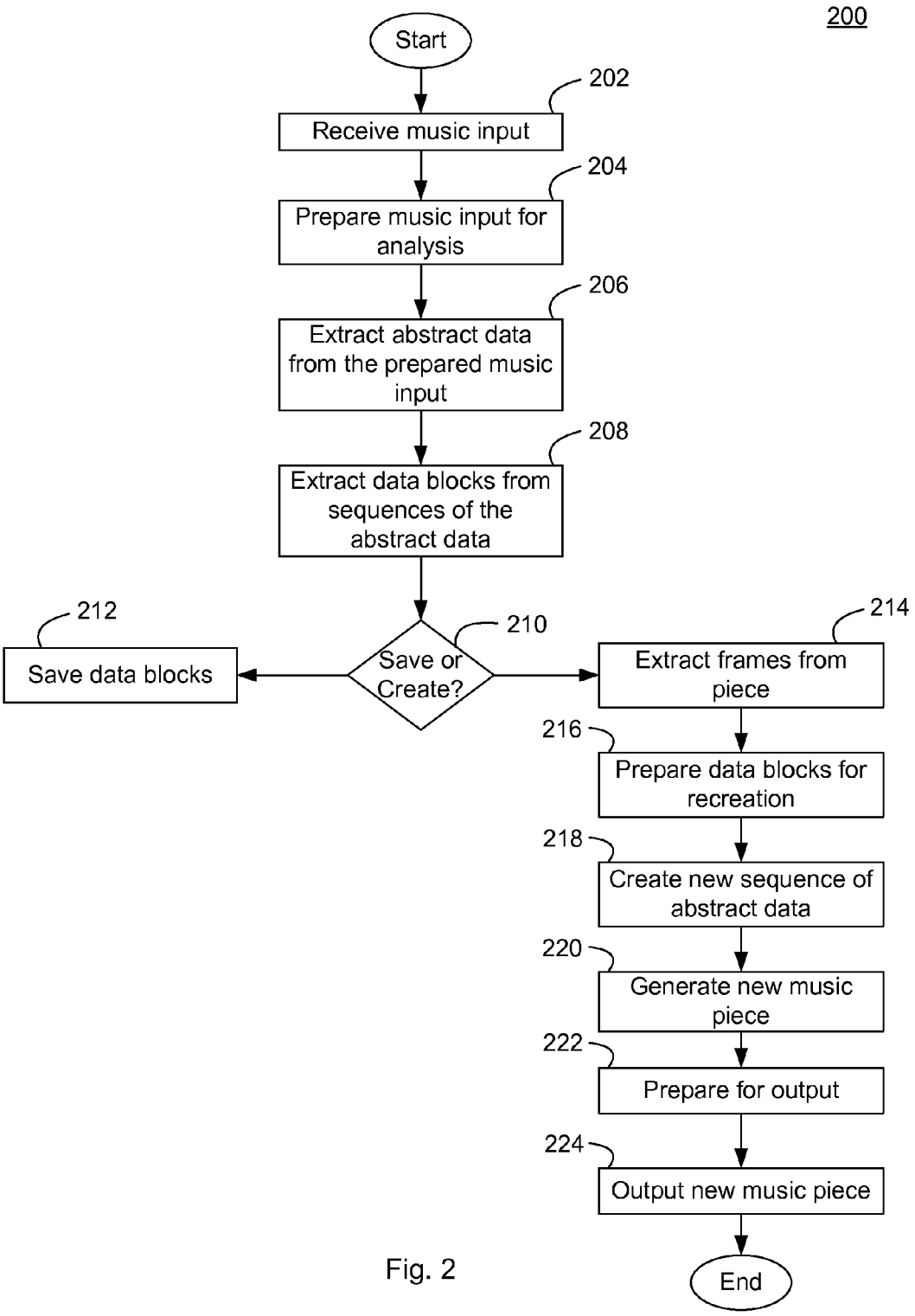
FIG. 2 illustrates a flowchart of a method for analysis and creation of music according to an embodiment of the present invention.

FIG. 2 presents a flowchart of a method for analysis and creation of music according to an embodiment of the present invention. The method of FIG. 2 may be executed in the system of FIG. 1 or any other suitable processing environment.

Music input is received, step 202. The music input may be in any format such as text, midi, or audio. Namely, musical notes are analyzed as opposed to sound waves. However, audio file formats such as MP3's may be received and parsed into notes. As such, the step of receiving music input may also include extracting musical notes from the music input.

In a next step 204, the music input is prepared for analysis. Music input pieces (whether from text, MIDI, or audio, etc.) are prepared in a standardized format before performing analysis. The first input preparation performed may be a standardization for time. The MIDI approach to rhythm is a system using ticks and tempo. Typically a note's length may comprise many thousands of ticks, sharply contrasting with text input in which very few note lengths are greater than 10. Therefore, a standardized system of dealing with time for analysis is desirable.

An ordered list containing the start and end times of all notes may be created. Let the elements of this list be numbered $\{x1, x2 \ldots x(n-1), xn\}$. Then the set of lengths between these events will be $\{(x2-x1), (x3-x2) \ldots (x(n)-x(n-1))$. The highest common factor of all lengths between events is used to divide all note lengths producing a standardized rhythmic framework for analysis.

The second input preparation performed may be the splitting of exactly repeating segments of the input piece of music. Many times in music, one can observe pieces or songs with whole sections that repeat. This is very commonplace in pop music where a verse-chorus-verse-chorus structure pattern appears in which the verses and the choruses are exactly the same. The music builder may be able to identify these patterns to analyze and create single sections of music which can then be "glued" together in the correct structure of repetition when preparing for output. To analyze such patterns, exactly repeating subsequences of notes in the input piece are identified.

In order to find such subsequences, the notes from the input piece of music are firstly arranged in an order such that the notes with earlier start times are listed before notes with later start times in a given sequence. If two notes have equal start times, notes with lower (higher by pitch) part numbers may be listed before notes with higher part numbers in the sequence. A list of all possible subsequences may then be derived from the ordered sequence of notes. For example, let a numerical representation of an ordered sequence of integers be 1,2,3,4. A set of subsequences generated from this ordered sequence may be:

{1} {1,2} {1,2,3} {1,2,3,4}
{2} {2,3} {2,3,4}
{3} {3,4}
{4}

Figure 3:
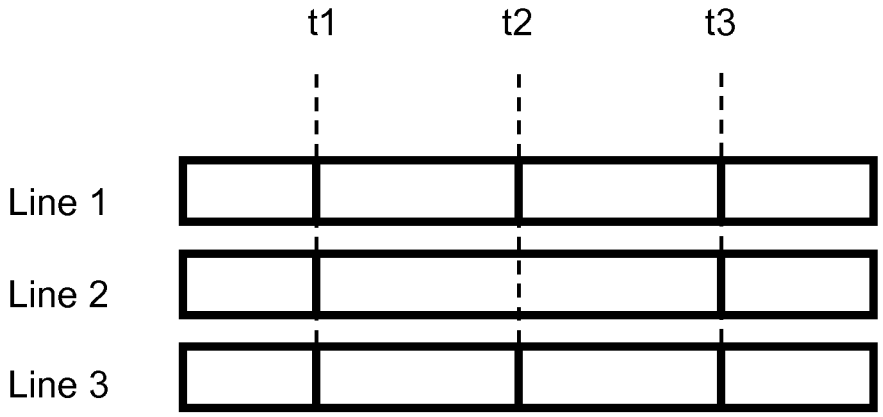
FIG. 3 illustrates a diagrammatical representation of a piece of music according to an embodiment of the present invention.

From the full set of subsequences of notes, start and end times of notes suitable to be segment boundaries are determined. Consider the diagrammatical representation of a piece of music in FIG. 3. It can be seen that no notes are sounding at t1 and t3. Therefore, these would be suitable times for segment boundaries. However, at t2, there is a sounding note held over t2, and as such, this is not a suitable segment boundary. Any subsequence of notes whose start or end times do not lie on suitable boundary times are removed from the list, leaving only subsequences with suitable boundary times.

Again referring to FIG. 3 as an example, any subsequences of notes with start or end times at t2 would be removed from the set of all subsequences. The remaining subsequences may then be compared for repetition. This involves finding a fitness measure for each repeating subsequences which may be given by a formula such as (fitness=number of repetitions of subsequence*(sum of all note lengths in subsequence)). This method is described in more detail in the section of this document that details blocks and frames which work in a very similar way to note subsequences and segments but concern abstract data rather than "solid" notes. Once the fittest subsequences of notes have been found, these form the segments of music which are passed through to the analysis module for separate analysis and recreation. The recreated segments will then be glued back together in the output preparation section according to the same structure by which they were input.

The third input preparation performed may be the splitting of tracks with simultaneously sounding notes into separate lines. This may be performed by finding a delta calculation between the pitch movements and splitting either by finding the minimum movements per each change of notes or by a total minimum change which can be calculated recursively across the piece.

Abstract data is extracted from the prepared music input, step 206. The abstract data may include patterns between the components of musical notes that are extracted from the music input. Examples include scale, keys, chords, rhythm, movement patterns and harmony. Extracting abstract data may include vertical and horizontal analysis of the input music. Vertical analysis may comprise scale, key, chord, and harmony analysis of the abstract data. Horizontal analysis may comprise rhythm, movement patterns, range, movement combinations, and key and chord combinations. These analyses are further described in the following sections below.

Data blocks are extracted from sequences of the abstract data, step 208. A set of data blocks may be derived from the original music input piece. The blocks may be comprised of sections of the abstract data. For example, the abstract data may comprise a key sequence and the blocks derived from the key sequence may include a portion or a subsequence of the key sequence. The blocks generated from the abstract data may either be saved or used to create new/original music, step 210.

Data blocks created from the abstract data may be saved in step 212. Blocks may be saved and stored in a database which can then be used at a future time by the music builder to create more diversity in new output pieces. Alternatively, in step 214, frames are extracted from the music piece. Blocks created from the music input may serve as building blocks for creating the frames. Frames may be extracted from the input piece by detecting repetitions of abstract data therein.

In step 216, data blocks are prepared for recreation. Blocks of abstract data may be retrieved or selected to recreate new abstract data sequences. New sequences of abstract data are created in step 218. Creating new sequences of abstract data may include generating new sequences of abstract data such as key sequences and chord sequences from "old" abstract data blocks (e.g., subsequences of key and chord sequences extracted from music input or from a storage medium such as a database). Blocks of abstract data can be joined in frames according to one or more rules based on previous analyses, for example, key and chord combination rules created from horizontal analysis to create the new sequences of abstract data.

From the new abstract data, new music piece(s) are generated, step 220. Generating new music may include determining possible pitches for notes comprising the new music piece(s). The new music may be composed by selecting pitches for the notes of the new music piece(s) based on reduction methods and movement combination rules (which are described in further detail in the sections below). In a next step 222, the new music is prepared for output. This process may involve line splicing (reversing the line splitting performed in the music input preparation described in step 204), segment splicing (reversing the segmentation of the music input), reversal of the time refactoring of the music input, and converting from internal data format to desired output data format (e.g., a MIDI file). When the new music has completed preparation, the new music piece is output, step 224.

Vertical Analysis Including Scales, Keys and Chords/Harmony

Figure 4:
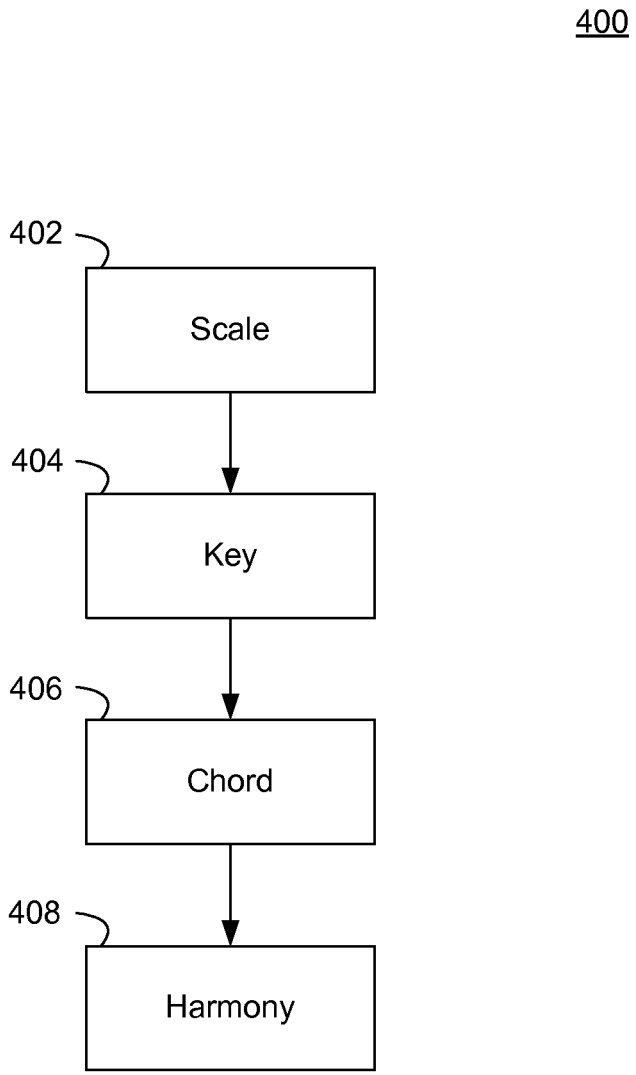
FIG. 4 illustrates a hierarchy of vertical components of music according to an embodiment of the present invention.

Vertical analysis (pertaining to multiple lines) refers to the analysis of music harmonically. The various stages of vertical analysis according to one embodiment rely on a system of hierarchy as shown in FIG. 4. Scale 402 is used as a basis of the vertical analysis. According to traditional music theory, the scale represents a set of musical pitches that dictate the base of a musical piece. For example, "Symphony in G major."

The concept of key 404 represents modulations that occur within a piece in relation to its underlying scale, for example, "C Major Section of Symphony in G Major." Chord 406 represents a framework for pitches that can sound simultaneously and harmonically together within a given key, for example, "Chord F Major in C Major Section of Symphony in G Major." Harmony 408 determines if currently sounding note pitches lie within the current chord or not, for example "Non-Harmony passing note 'G' over Chord F Major in C Major Section of Symphony in G Major." It should be noted that apart from harmony (which relies on chord), all of these concepts can exist independently of each other. However, for the purposes of analysis it is extremely beneficial to treat them as interdependent as this provides several layers of abstraction which can be used to detect the desired patterns within the piece of input music. For example, knowing that a chord of G Major repeats is unlikely to help much if the contexts that it appears in are very different. However, if it is known that chord 5 repeats, this gives a much better indication of how the music is constructed.

Scale

Traditionally the scale that a piece is based on is either a tonal key (i.e. G major, E minor etc) or a mode. However, neither of these is appropriate for analysis by a computer. The reason is that Major and Minor scales and modes are not mutually exclusive in terms of the scales they encompass. For example, listed below are a Major Scale, a Minor Scale and a mode:

C major—C,D,E,F,G,A,B

A minor—A,B,C,D,E,F,G

D dorian —D,E,F,G,A,B,C

As one can see, the above actually consist of the same notes in different orders. Now, bearing in mind that a standardized framework for analysis is desired, it is clear that one cannot simply use these different scalic frameworks as a basis. For example if a chord sequence of I, IV, V was analyzed in the C Major scale as shown above, this would lead to a chord sequence of CMaj, FMaj, GMaj. The same numerical sequence in the dorian mode would lead to a chord sequence of DMin, GMaj, AMin. Not only are these different chords but they are also different types of chords. This approach does not work. If one tries just using the chords themselves (i.e. CMaj, FMaj, GMaj) and then analyze a chord sequence of I, IV, V from any other Major key apart from C Major, then a match would not occur. However, a solution may be to analyze everything according to just one mode, the major scale and then to allow the chord sequence rather than the scale basis to express the nature of the mode. For example, the key of A Minor would be recorded and analyzed in the key of C Major with the starting and ending chords likely to be chord 6.

A goal is to find the key that has the most note pitches in the piece lying within it. Therefore, a group of the most frequently occurring 7 notes that lie consecutively by pitch with separation of an interval pattern based on a scale is determined. For example, the following interval is used:

2,2,1,2,2,2,1 (TTSTTTS=major, where "S" means a semitone and "T" means a whole tone (two semitones)).

A method according to one embodiment for finding a scale base is described. All note pitches in the piece are put into a range of one octave to eliminate any octave duplication in order to count their frequency. The frequency of occurrence of each of these new pitches are counted and a list of them is made in descending frequency where the most commonly occurring note pitch is at the first position of the list. The most frequently occurring seven note pitches which can ascend by pitch with an interval pattern of (2,2,1,2,2,2,1) (Major Scale) or any of its inversions are determined. A list of all possible combinations of 7 note pitches (ordered by descending total frequency) in the "octave pitch" is made. For example, if the note pitches obtained are 1,2,3,4,5,6,7,8, the following list of 7-note pitch combinations may be generated:

1,2,3,4,5,6,7
1,2,3,4,5,6,8
1,2,3,4,5,7,8
1,2,3,4,6,7,8
etc.

Now that a list of all groups of 7 note pitches in descending order of total frequency of occurrence have been generated, 7-note pitch combinations that fit a given interval pattern (or an inversion of it) may be determined. Each of the 7-note pitch combinations may be organized in ascending order of pitch. For each group (in ascending order) of 7 note pitches on the list, a difference is taken between consecutive notes and is used to match an interval pattern. This step may be repeated through a plurality of inversions of the 7 note pitches. The 7 note pitches are treated as a "circle" where the difference is taken between the first note and the seventh. As all note pitches are lying within one octave, the first note pitch is shifted up an octave to accomplish this. In terms of semitones, this is an addition of 12 (e.g., operations on the semitonal pitches are cyclic mod 12). Thus here if n1 is the first note pitch in the sequence and n7 is the seventh, results in an interval difference between the first and seventh pitches of (n1+12)−n7.

As an example, let the 7 note pitches be 0,2,3,5,7,8,10. Now taking the difference between each consecutive element, (n2−n1), (n3−n2) . . . ((n1−0)+(12−n7)) is: 2,1,2,2,1,2,2. This result is used to determine a match with the interval pattern of 2,2,1,2,2,2,1. Since the difference between each consecutive element does not match the interval pattern, the process may cycle through a next inversion of the 7 note pitches by putting the lowest pitch up an octave. Therefore, the next inversion will be: 2,3,5,7,8,10,12. Now taking the difference between each consecutive element is: 1,2,2,1,2,2,2. The difference is again compared with 2,2,1,2,2,2,1, and is not a match. The next inversion produces: 3,5,7,8,10,12,14. Again, taking the difference between each consecutive element is: 2,2,1,2,2,2, 1. In this iteration, the resulting difference between each consecutive element matches with the 2,2,1,2,2,2,1 interval pattern. Therefore the base note of the scale of 3 is determined as the scale base.

There are situations where musical pieces may not have a full 7 pitches with the right intervals needed to create a full scale. For determining a scale base for in situations such as this, the pitches may be lined up against the Major Scale set above of intervals in all inversions in order to determine the scalic pitch values of these semitonal pitches and then used to calculate the highest "in-keyness" where the descending order of in-keyness by scalic pitch is the following:

1
(4 or 5)
(2 or 7)
(3 or 6)

The inversion that has the highest "in-keyness" may be chosen as the scale base. The remaining scale pitches can then be calculated and filled in to complete the scale. For example, let {0,5,7} be the full set of semitonal pitches derived from the piece. Then assuming that the tonic or root note of the scale is in the first position in the framework (e.g., in any inversion, at least one of the pitches must be in the first slot), and using our "Major" set of semitonal intervals [2,2,1,2,2,2,1] as a framework, this set of semitones can be aligned in the following two ways:

[0,x,x,5,7,x,x]
[5,7,x,x, 12(0),x,x]

The slots correspond to scalic numbers. Now in the first array, pitches are placed in the first, fourth and fifth slots. In the second, pitches are placed in the first, second and fifth slots. Now by the hierarchy, described above, scalic pitch 4 takes precedence over scalic pitch 2. Therefore the scale base chosen is as described in the first array. That is to say, 0 is the scale base pitch.

Key

Figures 5, 6:
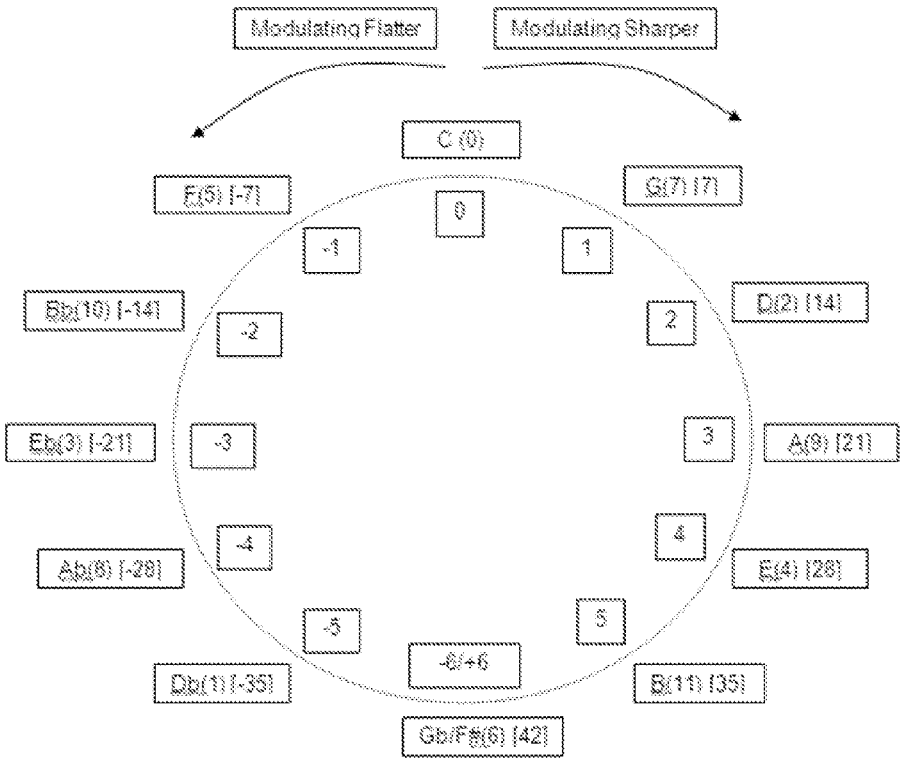
FIG. 5 illustrates a diagram for key modulation according to an embodiment of the present invention.
FIG. 6 illustrates an exemplary modulation table of semitones according to an embodiment of the present invention.

A traditional cycle or circle of fifths, as shown in FIG. 5, shows a circle of modulation, for flattening and sharpening keys. The boxes outside the circle denote pitch. This is shown firstly by letter in relation to the starting note followed by a number in rounded brackets (in this case C(0)). The number in rounded brackets (counted in semitones) denotes the pitch by a number which has been found by first taking the actual pitch and reducing it to a number between '0' and '11' by subtracting/adding by multiples of 12. Musically, this means all the theoretical pitches have all been moved into the range of one octave. Lastly, in square brackets indicates the actual pitch. The boxes inside the circle denote the number of sharps or flats that a key contains. Flats are represented by negative numbers while sharps are represented by positive numbers. Each key can only contain sharps or flats but not both (i.e., a number cannot be both positive and negative). Any key can contain any integer number of flats/sharps ranging from −∞ to ∞.

All keys represented are denoted by their major root (tonic). As the theoretical modulation occurs, any notes at a particular position on the circle will sound the same as any other note at the same position in the circle. For example, A[21] at position "3 o'clock" of diagram 2, sounds the same as Bbb[−63] which would also lie at "3 o'clock" if continued to show the modulation circle in the flat direction. A modulation in the sharp direction adds one flat (or decreases one sharp) and adds seven theoretical upwards semitones (theoretical because due to the cyclic nature of octaves, when considering octave-independent aspects of music such as key, any pitch can remain unchanged by adding/subtracting multiples of 12). Meanwhile, a modulation in the flat direction subtracts one flat and adds seven theoretical downwards semitones. Any key taken "out of theoretical context" can be expressed by using no more than 6 sharps or flats.

Any modulation can be expressed as both a flat modulation and a sharp modulation. This can be represented visually as moving both ways around the circle of fifths. As it happens, the sum of the moduli of these 2 directions adds up to 12. For example, looking at the circle in FIG. 5, modulating from C to G can either occur by moving 1 step clockwise, or 11 steps anti-clockwise (1+|−11|=12). A modulation algorithm according to one embodiment, will handle this kind of "enharmonic modulation" by choosing the modulation that requires the least movement around the circle.

From the above discussion of how keys are related, modulation may be detected by finding out-of-scale note pitches. For example, given the scalic base list of intervals, (2,2,1,2, 2,2,1), one can detect that a modulation has occurred when a pitch that does not fit in with this framework is encountered. Let the scalic base pitch here be 0. Then by the semitonal interval framework (2,2,1,2,2,2,1) and considering only one octave, semitones (0,2,4,5,7,9,11) will all be in-key. Semitones (1,3,6,8,10) will be out-of-key and will signify that a modulation has occurred. These out-of-key semitonal pitches each have a "degree of sharpness or flatness" that can be counted. When detection of a modulation has occurred, this modulation may be found by finding the key that requires the least movement around the circle in FIG. 6 to accommodate all of the out-of-key pitches. To aid in finding this key, a table can be created for the degrees of sharpness and flatness by going through this process for each single out-of-key pitch within the range of one octave. For example, a table of semitones 1, 3, 6, 8, 10 is illustrated in FIG. 6.

For any "out-of-key" pitch, let fN equal the least number of keys moved in a flat direction from the original key until the new pitch is found (the number of flats that need to be added to the original key to get to the first new key that the "out-of-key" pitch is denoting via the flat direction). For any "out-of-key" pitch, let sN equal the least number of keys moved in a sharp direction from the original key until the new pitch is found (the number of sharps that need to be added to the original key to get to the first new key that the "out-of-key" pitch is denoting via the sharp direction). For a group of "out-of-key" pitches, the flat modulation weight is the sum of all fN and the sharp modulation weight is the sum of all sN. The Highest Change Flat is the highest fN and the Highest Change Sharp is the highest sN.

For example, a C major has two out-of-key pitches, one lying 3 semitones above C and one lying 6 semitones above C. Pitch 3 is first examined. Looking at the table above, 2 keys can be traveled around on the circle in a flat direction until a new pitch is found. Therefore, fN=2. In the sharp direction, 4 keys around the circle can be traveled in the sharp direction until the new pitch is found. Therefore, sN=4. Looking at pitch 6, 5 keys around the circle can be traveled in a flat direction until the new pitch is found. Therefore fN=5. Traveling I key around the circle in a sharp direction can be performed to find the new pitch. Therefore sN=1. The flat modulation weight in this ease is 2+5=7 while the sharp modulation weight is 4+1=5. The Highest Change Flat is the greater number of {2,5}=5 and the Highest Change Sharp is the greater number of (4,1=4.

The concept of out-of-key pitches themselves having a degree of sharpness and flatness can be used to determine which way around the circle of fifths to modulate. According to an embodiment, a group of pitches including out-of-key pitches may be analyzed for modulation. Notes that are separated from other notes in the group by multiples of octaves (12 semitones) should be removed to maintain only one note for each particular pitch name in each group. Information about this group of pitches including the flat modulation weight, the sharp modulation weight, the highest change flat, and the highest change sharp, as described above, are determined. As mentioned above, the least amount of movement possible by which all "out-of-key" notes can be found in a new key are desired. If the flat modulation weight is less than the sharp modulation weight, a flat modulation is performed. If the sharp modulation weight is less than the flat modulation weight, a sharp modulation is performed. If the flat modulation weight equals the sharp modulation weight, no modulation is needed. When modulating in the flat direction, the amount of keys to move is equal to the highest change flat. When modulating in the sharp direction, the amount of keys to move is equal to highest change sharp.

From the earlier example of a group of out-of-key pitches to be 3 and 6 semitones above our starting key base note, the following values have been determined:

flat modulation weight=7
sharp modulation weight=5
highest change flat=5
highest change sharp=4.

The sharp modulation weight is less than the flat modulation weight, and as such, a modulation in the sharp direction may be performed. A move of 4 places around the circle of fifths in the sharp direction may be performed to find the new key (or adding 4 sharps to the current key signature). The flat modulation weight is equal to the sum of how far to travel to get to Bb Major (1st key containing Eb in flat direction) and how far to travel to get to Db Major (1st key containing pitch Gb). The sharp modulation weight is equal to the sum of how far to travel to get to E Major (1st key containing D# in sharp direction) and how far to travel to get to G Major (1st key containing F#). The Highest Change Flat is the number of flats that have to be added to C Major to get to Db Major. The Highest Change Sharp is the number of sharps that have to be added to C Major to get to E Major.

According to an embodiment of the present invention, a combination of forward and backwards analysis techniques are used for the key analysis of a musical piece. Forward analysis is a technique, according to one embodiment of the present invention, used to analyze and process a key sequence by scanning through a musical piece chronologically and, when out-of-key pitches are found, the modulation method described above is used to determine a key change. The analysis may begin in the key of the base scale note at time 0. When notes with out-of-key pitch(es) are identified, modulation is performed and the key of the musical piece is set to a new key according to the modulation found. This process may be performed for the entirety of a musical piece. For example, reference is made to the following string of note information:

[0,4,0][4,8,7][8,10,6][10,14,9][14,16,7][16,20,5][20,22,4][22,24,2][24,28,0].

The first number in the square brackets denotes the starting time of the note. The second number in the brackets denotes the ending time of the note. The third number in the brackets denotes the pitch relative to 0. This example starts off in key 0 (C major). At time 8, a semitonal pitch 6 is detected which is out-of-key. A modulation of 1 key sharp is determined and identifies a new key of 7. In musical terms, C major is the starting key and at time 8, an F# is encountered so modulation to G major is performed. At time 16, a note with pitch 5 is detected which is out-of-key in comparison to key 7. A modulation of 1 key flat is determined and identifies the new key is once again 0. In musical terms, at time 16, an F natural is encountered and modulation back to C major is performed. It may be determined that no out-of-key notes occur again in relation to 0 for this string of note information. Thus, by forwards analysis, the resulting key sequence may be as follows where the first number in the brackets denotes the start times of the keys and the second number in the brackets is the semitonal key base pitch:

[0,0][8,7][16,0]

Backwards analysis refers to the process of analyzing a key sequence similar to the forward analysis described above but in reverse-chronological order. In other words, the analysis is performed in the same manner as the forwards analysis but instead progresses from end time to start time rather than from start time to end time. Progressing backwards, it is the end times of the notes rather than the start times which will provide the "start times" of the new keys.

From the forward analysis example, the string of note information was,

[0,4,0][4,8,7][8,10,6][10,14,9][14,16,7][16,20,5][20,22,4][22,24,2][24,28,0].

Reversing this sequence, produces:

[24,28,0][22,24,2][20,22,4][16,20,5][14,16,7][10,14,9][8,10,6][4,8,7][0,4,0].

With a scale base of C major (0), analysis begins at 0. Traversing through the reversed list, at time 10, a semitone 6 which is out-of-key in comparison to 0 is detected. Therefore at time 10, the piece modulates to a key with semitone 7 as the base note. In musical terms, at time 10, an F# is detected and the key modulates to G Major. After time 10, moving chronologically backwards, it is determined that no additional out-of-key notes occur in relation to the key with key base note 7. Analyzing backwards, the piece ends in C Major. From time 10 until time 0, there is no note pitch that is out-of-key for G Major and therefore the piece stays in G Major until the end of the note string. Therefore, by backwards analysis, the resulting key sequence may be as follows where the first number in the brackets denotes the start times of the keys when moving in a reverse chronological order from the end of the piece to the start and the second number in the brackets is the semitonal key base pitch:

[28,0][10,7].

Once this key sequence is determined, it may then be reversed to obtain a backwards-analyzed key sequence in chronological order for key analysis of a musical piece. Taking the example sequence [28,0][10,7], this can be reversed to obtain a backwards-analyzed key sequence in chronological order of [0,7][10,0].

This method of forward and backward analysis allows analyzing both the gradual kind of modulation that is seen in many genres of classical music as well as the more sudden kind of modulation that is seen in a lot of rock and pop music. At the start of these modulations, the music often actually exists in two keys at once so and as such, the overlying chord sequence repetitions are analyzed in order to detect the most likely key sequence. The key analysis may generate a list of all the chord sequence numbers according to the modulations detected by each of the forward and backward analyses.

During this stage, chordal analysis (discussed in further detail below) may be performed in order to determine the most suitable key sequence as derived from the forwards and backwards analysis. Chord sequences may be generated from the key sequences of a musical piece after forward and backwards analyses. As discussed above, a chord represents a framework for pitches that can sound harmonically together in a given key.

The following is an exemplary chord sequence associated with a key sequence after forward analysis:

1,6,3,7,4,6,3,7,5,3,7,7,4,6,3,7.

Analyzing the same musical piece using backwards analysis, the following chronologically-reversed chord sequence may be produced:

7,3,6,1,7,3,6,1,6,6,6,1,7,3,6,1.

Inverting the above chord sequence back to chronological order produces the following backwards-analyzed chord sequence:

1,6,3,7,1,6,6,6,1,6,3,7,1,6,3,7.

Once the forward and backwards-analyzed chord sequences are obtained, the places in which the chord sequence generated from the forward analysis bifurcates (is in two keys at once) from the inverted chord sequence of the backwards analysis are determined. From these two chord sequences, the following illustrates how it can be seen where the chord sequences bifurcate.

4, 3,7,5,3,7, 4,
1,6,3,7, 6, 7, 6,3,7.
1, 6,6,1,6,3, 1,

Using the example above, a comparison of the two chord sequences result in two bifurcations consisting of an "upper" bifurcation (from the forward analysis) and a "lower" bifurcation (from the inverse backward analysis). The upper bifurcation includes [4], [3,7,5,3,7], [4] and the lower bifurcation includes [1], [6,6,1,6,3], [1]. In a next step, all possible full chord sequences are enumerated across all bifurcation combinations. Each "fork" is analyzed to find the most frequently occurring chordal repetitions. The forks of the above bifurcation are UUU→1,6,3,7,4,6,3,7,5,3,7,7,4,6,3,7
UUD→1,6,3,7,4,6,3,7,5,3,7,7,1,6,3,7
UDU→1,6,3,7,4,6,6,6,1,6,3,7,4,6,3,7
UDD→1,6,3,7,4,6,6,6,1,6,3,7,1,6,3,7
DUU→1,6,3,7,1,6,3,7,5,3,7,7,4,6,3,7
DUD→1,6,3,7,1,6,3,7,5,3,7,7,1,6,3,7
DDU→1,6,3,7,1,6,6,6,1,6,3,7,4,6,3,7
DDD→1,6,3,7,1,6,6,6,1,6,3,7,1,6,3,7.

The 'U' denotes the upper bifurcation and the 'D' denotes the lower bifurcation. Each fork may then be analyzed and the most frequently occurring chordal repetitions or sub-sequences (e.g., 1,6,3,7) are identified. The most frequently occurring sub-sequences are calculated to determine which "side" of the bifurcation is the most likely one to contain a key sub-sequence with the best "fitness." For all possible chord sub-sequences within these full chord sequences, fitness values are calculated where fitness=sub-sequence length*frequency. That is, the fitness score is equal to a given sub-sequence length multiplied by its frequency of occurrence. Each chord sub-sequence may be weighted equally. For example, a sub-sequence that is not in a bifurcated area should have a reduced "weight" in the analysis as it is being analyzed multiple times (the 1,6,3,7 that begins all sequences should not be counted 8 times). The fitness value may be multiplied by $$\frac{2^m}{2^n}$$

to get a weighted fitness value, where 'm' is the number of bifurcations in a given sub-sequence and 'n' is the total number of bifurcations. In the current example, n=3. The beginning chords 1,6,3,7 includes no forked sub-sequences which results in m=0. On the other hand, a sub-sequence including the first 5 chords, 1,6,3,7,4 has a chord from one fork and therefore, m=1.

A chord sub-sequence with the highest weighted fitness value is determined. If there is more than one sub-sequence with the same fitness, one of those chord sub-sequences may be chosen randomly. In this instance, it may be determined from calculating the weighted fitness values the sub-sequence 1,6,3,7 is the most frequently occurring chord sub-sequence of length 4. In addition, the sub-sequence length of 4 allows creating 4 consecutive instances the sub-sequence, which would entirely fill the whole 16 chord sequence. In order to accommodate this chord sequence, the choice of key sequence bifurcations (the bifurcation "route") is D, U-D, D, where in the middle bifurcation, the key changes from the upper fork to the lower one at the time of the start of the third chord in the bifurcation. Going back to the bifurcation representation, 4, 3,7,5,3,7, 4,
1,6,3,7, 6, 7, 6,3,7,
1, 6,6,1,6,3, 1, the following chord sequence may be created from the key analysis using the 1,6,3,7 sub-sequence:

1,6,3,7,1,6,3,7,1,6,3,7,1,6,3,7.

The analyzed key sequence may be set according to the above chord sequence. The key sequence is set to ensure that the bifurcation route fully accommodates all instances of the new chord sequence. In other words, the key sequence must be such that this chord sequence can exist in all its instances.

The produced key sequence may be standardized to start with a key of 0 (if necessary). This allows it to be stored and used in combination with other standardized key sequences.

To do this, the first key of the sequence may be transposed to 0 and the rest of the keys are transposed accordingly by the same transposition of the first key. A note can then be made of the transpositional difference so that it can be re-transposed at output if required. This will enable the original keys to be preserved. A large amount of mid-Baroque music may lie in keys with 0-3 accidentals, whereas 20th Century pieces may contain more keys with more accidentals. Key sequences may be analyzed starting in a key with no accidentals (C major/A minor/Aeolian etc.), however, the re-transposing can preserve this stylistic approach to using the different keys.

Chord

A next step of vertical analysis focuses on chord sequences in relation to each key. According to one embodiment, chord analysis may take place "inside" the key analysis. During the key analysis stage, chord analysis may be performed in order to determine the best/fittest key sequence (or refine the key sequences from the key analysis stage). For example, key analysis may produce several possible key sequences. For each of these, chord analysis may be performed in order to aid in determining the best/fittest key sequence. Chord analysis may also take place after the key sequence is finalized, in which case a more accurate but less efficient algorithm may be employed in order to determine more accurate results. Chordal analysis may be employed to write chord sequence blocks to the music builder's database and use them along with chord frames to create new chord sequences. According to an embodiment, chordal analysis may include traversing through a piece of music chronologically, creating, updating, and saving "ghost chords" to generate new chord sequences. Ghost chords are temporary chords that are updated throughout a particular chordal analysis until they become finalized, at which point the chord is "saved" to an output sequence. A ghost chord may initially include a dynamic and/or non-definite harmony that may change across time and become a definite chord when analysis of a sequence of notes for the ghost chord has finished.

Chordal analysis may include examining sets of notes chronologically, creating, updating and finalizing ghost chords while following certain rules and accounting for "essential fragments" and "inessential fragments." An essential fragment is a note or part of a note that adds its pitch value to a ghost chord. Inessential fragments are notes or parts of a note whose pitch is ignored in the chordal analysis (covering the non-harmony parts of traditional non-harmony structures such as passing, suspension, pedal, etc.). An inessential fragment may be defined as a note or a section of a note that does not add to the harmony. It may also encompass all different traditional non-harmony notes. Identification of inessential fragments are subject to the following requirement: the fragment of the note in question is flanked on at least one side by an essential fragment with a pitch difference between the two notes less than or equal to 2 semitones. Inessential notes may characterize non-harmony notes such as "passing notes" and "suspensions," where their pitches do not affect the overall harmony.

The chordal analysis is contributed to by the pitches of any note fragments that do not qualify as inessential fragments. As an inessential fragment should be connected to at least one essential fragment, it can be deduced that for any adjacent three note fragments in a single line (or part), at least one of them must be essential and contributing to the chordal structure. A ghost chord is finalized once it contains pitches that fill a predetermined chordal analysis interval. Examples of suitable choices for this interval are a scalic 5th or 7th. Once a ghost chord is finalized it may not be further updated. Any subsequent essential fragment pitches must lie on the triadic intervals within the finalized ghost chord, otherwise, a new ghost chord is created.

By the process described above, many areas of a musical piece will have a definite chordal definition. However, there are instances (more commonly when fewer voices are sounding simultaneously or a higher analysis interval is chosen) in which the chordal definition is ambiguous. In this instance, all harmonic possibilities should be evaluated and a fitness function may be employed to guide to a decision for a final result. For harmonically ambiguous pitches (one that can either be an inessential fragment or an essential fragment), analysis may need to be "forked" and a fitness function may be applied to all forks generated. For example, if there is a passage containing 6 notes that could be described as inessential, 2^6 different forks of analysis may be created in order to accommodate all possible combinations. However, this may be reduced by noting that an inessential fragment must be tied to an essential fragment within its line. Therefore, for example, forks of analysis which contain 3 or more consecutive inessential fragments within a line may be eliminated.

When attempting to update a ghost chord with a pitch whose inclusion results in there being no existence of an inversion of pitches whose highest number of the resultant chord lies within the designated analysis interval, then a transgression of the ghost chord will be caused. For example, if the designated analysis interval was a $5^{th}$ and the pitches contained in the ghost chord were (0(C), 7(G)), then if (11(B)) were added, all of the pitches cannot be contained within an interval of a fifth, and a transgression will be caused. A note pitch added to a current ghost chord that causes a transgression may instead be added to a new ghost chord. As such, the current ghost chord may be finalized and added to the chord sequence, and a new ghost chord is created for the new note pitch.

To begin chordal analysis, all notes may be placed into a range of one octave for each line of notes. Then any adjacent notes which share the same pitch may be joined together to become a single note. An analysis interval may be determined for the ghost chords (this may be determined by user input or an initial heuristic scan). A fitness function is determined for evaluation of essential/inessential fragment combinations (this also may be determined by user input or an initial heuristic scan). Fitness functions may include either one or a combination of the following goals:

to find a chord sequence that has the lowest triadic chordal numbers possible (e.g., standard chords based on triads are preferred to 7th chords which in turn are preferred to 9th chords etc.), to find a chord sequence in which the most note pitches lie (to have as few inessential fragments as possible), and to find a chord sequence that provides the most tempered harmonic rhythm for the piece.

Chordal analysis includes chronologically iterating through all note start times. For each start time, any notes that are held may be temporarily "cut." This allows deducing note fragments that may be created if a harmonic change is detected at the start time. A set of pitches that will sound at each start time is created and the following analysis steps are taken:

1) IF there exists a current ghost chord and all pitches in S can fit within it, filling the analysis interval, OR if all note pitches in S already lie in the ghost chord, then update the current ghost chord with these pitches and continue the iteration, 2) ELSE IF all pitches in S can exist within a new ghost chord, filling the designated analysis interval, then write the current ghost chord (if exists), create a new ghost chord and update it with all pitches in S and continue the chronological iteration, 3) ELSE IF any pitches in S can be described as inessential fragments, analyze all possible combinations of these and apply the fitness function to find the best result (i.e. which combination of inessential and essential fragments lead to the fittest chord sequence). It may be necessary to "temporarily" analyze further into the piece recursively in order to achieve this. Once the optimal combination of inessential/essential fragments has been determined, then write, create and update ghost chords appropriately, 4) ELSE, IF the pitches in S can fit within the current ghost chord, update it. ELSE, write the current ghost chord (if one exists), and then create a new ghost chord and update it by all pitches in S (this may push the ghost chord past its designated analysis interval and allows extended chords even in the case of a low analysis interval).

Figure 7A:
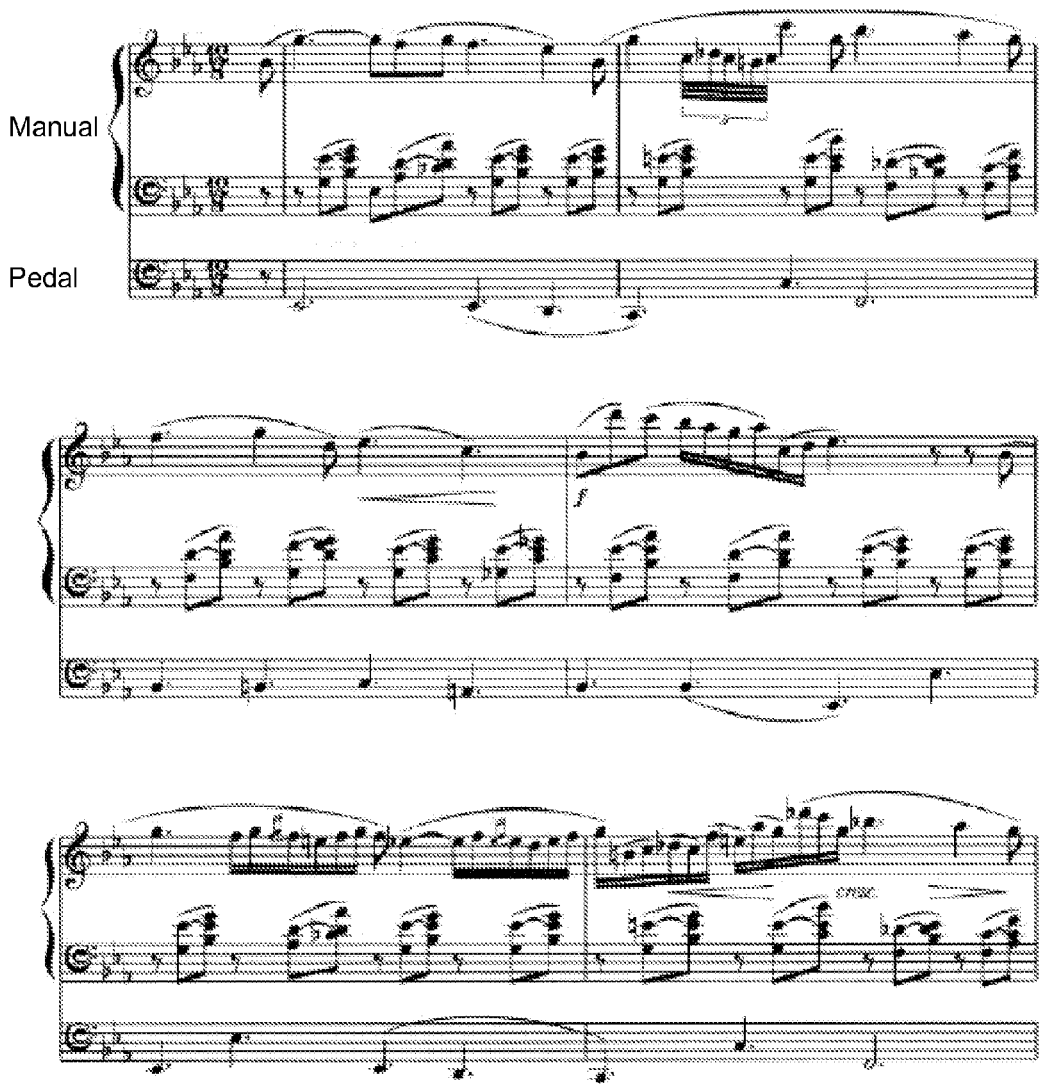
FIG. 7A and FIG. 7B illustrate exemplary musical pieces used for performing chordal analysis according to an embodiment of the present invention.

The following is an exemplary process for performing chordal analysis with reference to the musical piece by as shown in FIG. 7A. The musical piece is analyzed in chronological order (left to right) beginning with the first note using the following parameters:

Analysis Interval=5th

Fitness Function=Lowest triadic chordal numbers preferred. If possibilities with equal lowest triadic chordal numbers are encountered, aim to choose the chord sequence with the most essential fragments contributing to it. If possibilities with equal lowest triadic chordal numbers and an equal number of essential fragments are encountered, aim for as tempered harmonic rhythm as possible.

Ghost chords take the format m[n1, n2 . . . nx] where m is the current overall value of the ghost chord and the n values denote pitches that contribute to the ghost chord. Let this be counted in 4 beats per bar with 3 divisions per beat.

Bar 0, beat 4.3—Has Bb.

ANALYSIS 1: No ghost chord exists.

ANALYSIS 2: This cannot fill a new ghost chord with an interval of a 5th.

ANALYSIS 3: This cannot be an inessential fragment as it is not flanked on either side by a note of pitch difference<=2 semitones.

ANALYSIS 4: The pitch must contribute to the harmony. No ghost chord exists so a new one is created and is updated with the pitch. The result is Bb[Bb].

Bar 1, beat 1.1—Has {Eb, G}.

ANALYSIS 1: This can fill the currently existing ghost chord to the designated analysis interval (5th). The result is Eb[Eb, G, Bb].

Bar 1, beat 1.2—Has (Eb, G, Eb, G).

ANALYSIS 1: All of these pitches already lie within the current ghost chord. The ghost chord remains as Eb[Eb, G, Bb].

Bar 1, beat 1.3—Has {Eb, Bb, Eb, G, G}.

ANALYSIS 1: All of these pitches already lie within the current ghost chord. The ghost chord remains as Eb[Eb, G, Bb].

Bar 1, beat 2.1—Has (Eb, Eb, G)

ANALYSIS 1: All of these pitches already lie within the current ghost chord. The ghost chord remains as Eb[Eb, G, Bb].

Bar 1, beat 2.2—Has {Eb, Ab, D, F}.

ANALYSIS 1: This set of pitches cannot update and fill the current ghost chord to the required interval.

ANALYSIS 2: This set of pitches cannot fill an empty ghost chord to the required interval of a 5th.

ANALYSIS 3: The Eb, D and F all have flanking fragments that are separated by pitch<=2 semitones. Therefore all of these pitches at this stage have the possibility of being inessential fragments. It cannot be determined how the analysis will develop at this point and will need to create a forked analysis here. As there are three pitches here that could or could not be inessential fragments, a combination of 2^ 8 paths are generated to explore at the next step.

The following analysis takes place within recursive loops. Each instance of this analysis at each time step will have definite values of ghost chords and how they are being updated. However, for simplicity, each set of instances per time will now be treated generically and therefore fork-specific ghost chords will not be considered.

ANALYSIS 4: Dependent on fork of analysis.

Bar 1, beat 2.3—Has {Eb, B, D, Ab, G} (Cb will have been analyzed previously in the key analysis as a B natural).

ANALYSIS 1: Regardless of the currently existing ghost chord in this analysis loop, the current notes cannot lie on triadic chordal pitches within the interval of a fifth.

ANALYSIS 2: This cannot fill a new ghost chord with an interval of a 5th.

ANALYSIS 3: The Eb, D and G all have flanking fragments that are separated by pitch<=2 semitones. Therefore these pitches at this stage have the possibility of being inessential fragments. Again, forked branches of analysis are created in order to determine how these possibilities may develop.

ANALYSIS 4: Dependent on fork of analysis.

Bar 1, beat 3.1—Has {Eb, F}.

ANALYSIS 1: These pitches cannot fit into any currently existing ghost chord.

ANALYSIS 2: They cannot fit into a new ghost chord with an analysis interval of a 5th.

ANALYSIS 3: Both of these pitches could be classed as inessential fragments. Further forks are created in the analysis.

ANALYSIS 4: Dependent on fork of analysis.

Bar 1, beat 3.2—Has {Eb, G, Eb, F}.

ANALYSIS 1: These pitches cannot fit into any currently existing ghost chord

ANALYSIS 2: They cannot fit into a new ghost chord with an analysis interval of a 5th.

ANALYSIS 3: All pitches except for the G could be classed as inessential fragments. Therefore, further forks are created in the analysis.

ANALYSIS 4: Dependent on fork of analysis.

Bar 1, beat 3.3—Has {Eb, Bb, Eb, G, F}.

ANALYSIS 1: These pitches cannot fit into any currently existing ghost chord.

ANALYSIS 2: They cannot fit into a new ghost chord with an analysis interval of a 5th.

ANALYSIS 3: All pitches except for the Bb and G could be classed as inessential fragments. Therefore, further forks are created in the analysis.

ANALYSIS 4: Dependent on fork of analysis.

Bar 1, beat 4.1—Has {D, Eb}

ANALYSIS 1: These pitches cannot fit into any currently existing ghost chord.

ANALYSIS 2: They cannot fit into a new ghost chord with an analysis interval of a 5th.

ANALYSIS 3: Both of these pitches could be classed as inessential fragments. Further forks are created in the analysis.

ANALYSIS 4: Dependent on fork of analysis.

Bar 1, beat 4.2—Has {D, G, Eb, Eb}.

ANALYSIS 1: These pitches cannot fit into any currently existing ghost chord.

ANALYSIS 2: They cannot fit into a new ghost chord with an analysis interval of a 5th.

ANALYSIS 3: Both of the Eb pitches could be classed as inessential fragments. Therefore, further forks are created in the analysis.

ANALYSIS 4: Dependent on fork of analysis.

Bar 1, beat 4.3—Has {D, Bb, Eb, G, Bb}.

ANALYSIS 1: These pitches cannot fit into any currently existing ghost chord.

ANALYSIS 2: They cannot fit into a new ghost chord with an analysis interval of a 5th.

ANALYSIS 3: The D and Eb pitches could be classed as inessential fragments.

Therefore, further forks are created in the analysis.

ANALYSIS 4: Dependent on fork of analysis.

Bar 2, beat 1.1—Has {C, G}.

ANALYSIS 1: This is dependent on a given fork (although by observation, this is not going to be possible in any currently existing fork).

ANALYSIS 2: They can fit into a new ghost chord with an analysis interval of a 5th.

Therefore, at Bar 2, beat 1.1, a definite harmony is found. This serves as an "anchor" for the harmonic analysis and the recursive forked analysis comes to a close. In this passage, 20 pitches have been identified which may or may not be inessential fragments. To find all combinations of these, 2°forks of analysis are created, which may then apply the fitness function to in order to determine the correct chord sequence. However, this can be reduced. As mentioned above, no three inessential fragments can exist next to each other in a line. By similar logic, the ties in the left hand manual (organ terminology) cannot both be inessential fragments (as each must be adjoined to an essential fragment). Therefore, at points in the recursive analysis in which illegal forks are detected, these forks may be discarded.

Using the fitness function above which aims to find the lowest chordal triadic numbers, least amount of inessential fragments and most tempered harmonic rhythm, in that order of priority, the following final chord sequence may be produced:

Bar 0, beat 4.3->Bar 1 beat 2.1—Eb (Major),

Bar 1, beat 2.2—D (Diminished),

Bar 1, beat 2.3—B7 (Diminished),

Bar 1, beat 3.1—Bar 2, beat 1.1 Eb (Major).

On beat 2.2, it may seem that the chord could equally have been Ab (Major) by the "lowest triadic chordal number" criterion, but D (Diminished) was chosen by the "least inessential fragments" criteria as well as the fact that the 'G,F,G' in the upper part would all have had to have been inessential fragments to accommodate this.

On beat 3.1, the chord could equally have been B7 Diminished by the "lowest triadic chordal number" and "least inessential fragments" criteria of the fitness function but Eb was chosen by the tempered harmonic rhythm criterion. This method of analysis has generated non harmony pedals (the Eb in the bass under the diminished D diminished & B7 diminished chords) and passing notes (the G in the upper register of Bar 1, beat 2.3, the F in the upper register of Bar 1, beat 3 and the D in the bass of Bar 1, beat 4). This example also shows how this algorithm allows for two consecutive inessential fragments (the G and F in the upper register of Bar 1 beat 2.3->beat 3).

If an analysis interval of a 7th is used rather than a 5th, Bar 1, beat 2.2 would also have been analyzed as a B7 Diminished chord (there would have been just one chord shared by beats 2.2 and 2.3). The ghost chord generated at beat 2.2 D[D,F,Ab] would have been updated to B7[B, D, F, Ab] on beat 2.3. Additionally, the D in the bass of Bar 1, beat 4 would not have been an inessential fragment but would have updated the Eb chord to an Eb7. The reason for choosing an analysis interval of a 5th here is that in general, taking higher analysis intervals means that less ghost chords are filled and additional recursion and forked analysis may be involved.

According to an alternative embodiment, it is possible to reduce the functionality of the algorithm to achieve greater efficiency whilst achieving acceptable analysis results in certain situations. One example of many ways of restricting the algorithm is the following: inessential fragments should be flanked on both sides by a fragment or note of equal or greater length. (here the concept of a note is used in addition to that of a note fragment as for this reduced algorithm will be iterating forwards (no recursive forks are required) and hence unable to determine the size of succeeding note fragments at the time of each analysis). Also, let no two inessential fragments exist adjacently within a line.

For each time pitches are encountered that cannot lie within the analysis interval and can be described as inessential fragments, two values are determined, pNum—the number of transgressions the set of note pitches makes with the currently existing ghost chord, and nNum—the number of transgressions the current set of note pitches makes with the ghost chord generated by the next set of note pitches.

The following rule is used to determine how the inessential fragment affects the chordal analysis:

IF pNum<nNum, do not update the current ghost chord, ELSE use the note pitches that occur at the next time in the sequence to update the ghost chord by using ANALYSIS STEP 4.

This is may be seen as "hard-coding" a reduced version of the fitness function criteria whose goal is to find a chord sequence in which the most note pitches lie (to have as few inessential fragments as possible).

The four steps of analysis mentioned previous may therefore slightly modified to the following:

ANALYSIS STEP 1: IF there exists a current ghost chord and all pitches in S can fit within it OR IF all note pitches in S already lie in the ghost chord, then simply update the current ghost chord with these pitches and continue the iteration.

ANALYSIS STEP 2: ELSE IF the number of pitches in S>1 AND all pitches in S can exist within a new ghost chord, then write the current ghost chord (if exists), create a new ghost chord and update it with all pitches in S and continue the chronological iteration.

ANALYSIS STEP 3: ELSE IF any pitches in S can be described as inessential fragments, find pNum and nNum. IF pNum<nNum, continue the time iteration ELSE use ANALYSIS STEP 4 with (S=the pitches that are sounding at the next time in the iteration).

ANALYSIS STEP 4: ELSE, IF the pitches in S can fit within the current ghost chord, update it. ELSE, write the current ghost chord (if one exists) and then create a new ghost chord and add update it by all pitches in S (this may push the ghost chord past its designated analysis interval and allows extended chords even in the case of a low analysis interval).

Figure 7B:
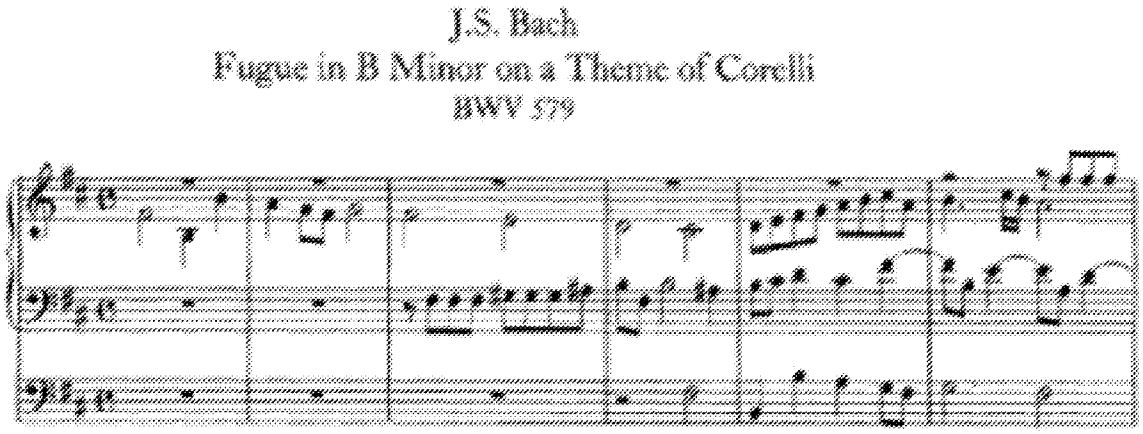

The following is an exemplary process for performing a "reduced" chordal analysis with reference to the musical piece by as shown in FIG. 7B.

Bar 1, beat 1—Has {F#}.

ANALYSIS 4: A new ghost chord, F#[F#] is set up.

Bar 1, beat 3—Has {B}.

ANALYSIS 4: The current ghost chord is updated to B[B, F#].

Bar1 beat 4—Has (B}.

ANALYSIS 1:'B' already exists in the ghost chord.

Bar 2, beat 1—Has {A}.

ANALYSIS 4: The old ghost chord is written and a new one, A[A] is set up.

Bar 2, beat 2—Has {G}.

ANALYSIS 3: This can be described as an inessential fragment.

Here G when compared to the ghost chord A[A]=1. If looking ahead to the next time there is a temporary ghost chord F#[F#]. Now G when compared with ghost chord F#[F#]=1. Therefore, ANALYSIS STEP 4 is used with the set of pitches {F#}. The ghost chord is now updated to [F#, A].

Bar 2, beat 2.5—Has {F#}.

ANALYSIS 1: This pitch already exists in the current ghost chord.

Bar 2, beat 3—Has {G}.

ANALYSIS 4: The old ghost chord is written and set up a new one G[G].

Bar 3, beat 1—Has {F#}.

ANALYSIS 3: This can be described as an inessential fragment.

Here pNum (F#, when compared to the current ghost chord)=1. nNum (F# when compared to the chord generated by the pitches at the next time in the sequence)=0. Therefore, the old ghost chord is written and set up the new ghost chord F#[F#].

Bar 3, beat 1.5—Has {F#}.

ANALYSIS 1: This pitch already exists in the current ghost chord.

Bar 3, beat 3—Has {E, G#}.

ANALYSIS 2: The old ghost chord is written and a new ghost chord E[E, G#] is set up.

Bar 3, beat 4.5—Has [A#, E].

ANALYSIS 2: The old ghost chord is written and set up the new ghost chord A#[A#, E].

Bar 4, beat 1—Has [B, D].

ANALYSIS 2: The old ghost chord is written and set up the new ghost chord [B,D].

Bar 4, beat 1.5—Has [F#].

ANALYSIS 1: This updates the current ghost chord to B[B,D,F#].

Bar 4, beat 2—Has [B].

ANALYSIS 1: This already exists in the current ghost chord.

Bar 4, beat 3—Has [F#,B, C#].

The start time contains pitches (B and C#) which could be classed as inessential (the B minimum is "cut" here into two crotchets for analysis so this does satisfy the length rule).

ANALYSIS 3: Here pNum ({F#, B, C#} when compared to the current ghost chord)=1 (i.e. I pitch (C#) conflicts with the current ghost harmony B[B,D,F#]. Here nNum (F# when compared to the chord generated by the pitches at the next time in the sequence F#[F#,A#,C#]=1 (the 'B' conflicts). Therefore, the current chord is written and a new chord F#[F#,C#] is set up.

Bar 4, beat 4—Has [F#, A#, C#].

ANALYSIS 1: The current ghost chord is updated to F#[F#, A#, C#].

The remaining passage is omitted for brevity.

The final chord sequence produced may be the following:

Bar 1, beat 1->Bar 2, beat 1—Bminor,

Bar 2, beat 1->Bar 2, beat 3—F#minor,

Bar 2, beat 3->Bar 3, beat 1—G major,

Bar 3, beat 1->Bar 3, beat 3—F#minor,

Bar 3, beat 3->Bar 3, beat 4.5—E major,

Bar 3, beat 4.5->Bar 4, beat 1—A#Diminished,

Bar 4, beat 1->Bar 4, beat 3—B minor,

Bar 4, beat 3->Bar 5, beat 1—F#Major.

This shows that although the functionality here is greatly reduced (pedals are not detected, and also chronologically consecutive combinations of inessential fragments are not supported), analysis results may be achieved with a simplified algorithm that runs in polynomial time.

Harmony Analysis

From the new chord sequences created from chordal analysis, a determination may be made as to which pitches lie within a given chordal harmony and which do not. Pitches that do are recorded as harmony pitches and those that do not are recorded as non-harmony pitches. For non-harmony pitches, information such as the previous scale number in the line (unlimited, not cyclic), the current scale number in the line (unlimited, not cyclic), the next scale number in the line (unlimited, not cyclic), the previous chord, the current chord, the next chord, the previous key, the current key, the next key, and the set of other sounding scalic numbers may be recorded and used to determine new possible pitches in the creation of new music. Previous, current and next refer to the boundaries of the inessential fragments analyzed during chordal analysis. This information may be used to determine which kinds of non-harmony pitches are stylistically allowed from the input and a set of criteria for allowed non-harmony pitches for use during the recreation stage, which is described in further detail below.

This particular set of information may be the least amount of required information that can satisfactorily preserve the "flavour" of the non-harmony pitch that can then be reproduced when producing new music. For example, with values of PrevKey=D, Current Key=D, Next Key=D, PrevChord=Bmin, CurrentChord=F#, Next Chord=F#, PrevScalicNumber=6, CurrentScalicNumber=6, NextScalicNumber=5#, Other Sounding Scalic Numbers=[3,7]. Therefore, there is no key change and this is a 4-3 suspension (as traditionally expressed by scalic number within chord rather than key) in the chord of F# having come from the chord of B Minor. Also, at the time of the suspension, chordal pitches 1 and 5 are also sounding.

Horizontal Analysis—Movement Patterns and Movement Combinations

Whereas vertical analysis pertains to the relationships between multiple simultaneously sounding notes, horizontal analysis pertains to the patterns within a series of notes that do not sound simultaneously. This may be the analysis of patterns that exist within one musical "part" or played by a solo instrument. It is worth noting that if the input "part" had multiple simultaneously sounding notes (e.g., a piano or double-stopping violin), these would have been split into "lines" of independently sounding voices at the stage of input preparation. A comparison of the analysis of these individual musical parts may also be made. For example, rhythms that are repeating across all parts may be identified.

Rhythm

Rhythm analysis includes the analysis of repeating rhythms within the individual musical parts. The rhythm may be stored as a sequence of integers that represent the note lengths of the rhythm. For example, each note may be examined for each separate line (part) of music. If an examined note is the first note in the line, a new rhythm sequence is created and the note's length is added. If it is not the first note in the line, check if the preceding note in the line has an end time that is equal to the current note's start time. If this is the case, the current note's length is added to the current rhythm sequence. Otherwise, a new rhythm sequence is created and the current note is added to it. A new rhythm sequence provides a framework of pitch empty notes that can be used in the "population" stage of music recreation, which is described in further detail below.

Movement Patterns

Figure 8:
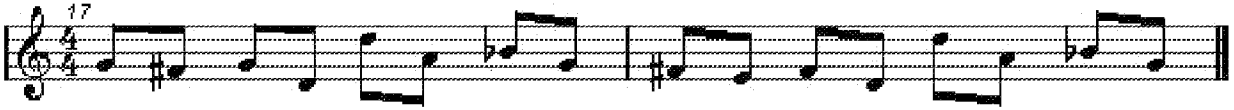
FIG. 8 illustrates a musical example referred to in a discussion of movement patterns according to an embodiment of the present invention.

Movement patterns may be a term used to describe the way that a musical part moves upwards and downwards, and is important for the successful writing of imitative music. The basic idea of a movement pattern is that it describes the "shape" of a musical motif in terms of upwards, downwards and non-changing movements. Considering a musical example illustrated in FIG. 8 it can be seen that the first note is higher than the second. The third note is as high as the first note and is therefore higher than the second. The fourth note is lower than all three preceding notes etc.

The music builder can record this kind of movement pattern in a sequence of positive integers with the lowest note denoted as 1. Looking at the first bar of the example, the lowest note is the fourth note, D. With "x" denoting pitches to be completed, the following is produced:

x,x,x,1,x,x,x,x.

Next, a F sharp is at the second note. The pattern is now x,2,x,1,x,x,x,x

The next highest pitch is a G which occurs at places 1, 3 and 8. The pattern is now 3,2,3,1,x,x,x,3

The A at position 6 updates the pattern to 3,2,3,1,x,4,x,3

Then the B flat at position 7 updates the pattern to 3,2,3,1,x,4,5,3

Finally, the highest note, the top D completes the pattern 3,2,3,1,6,4,5,3

Using the same system of analysis on the first seven notes of bar 2, produces:

3,2,3,1,6,4,5 (which matches that of the first bar).

Range

Range dictates the lowest and highest notes for each of the individual musical parts (for example, in a choir, the soprano part will have a generally higher range than the bass which will have a low range). The range describes the upper and lower bounds for the possible pitches of each musical part or voice. For example, a keyboard instrument that is input as a MIDI track may have many different simultaneously sounding notes but overall, the instrument as a whole has a definite range. Range analysis includes identifying the lowest pitch and the highest pitch for each track. The recorded inclusive interval between them is the range of the part. Range analysis can be used in the "population" stage of music recreation. The population step may start with a new "pitch empty" rhythm sequence. For each note, the note may be fully populated with pitches bounded by the range of the line in which the note lies.

Movement Combination Rules

Movement combinations may be used by the music builder for "part writing." This is the way in which pitches are chosen that are consistent vertically with the underlying chordal structures of the notes as well as acceptable horizontally, both within their own lines (to be smooth) as well as in their relationships with the other simultaneous horizontal movements (e.g., to avoid genre-specific part writing problems such as parallel 5ths).

There are nine types of movement combinations that the music builder may analyze. These can be divided into three subgroups. The nine types and their respective subgroups are listed below.

Figure 9:
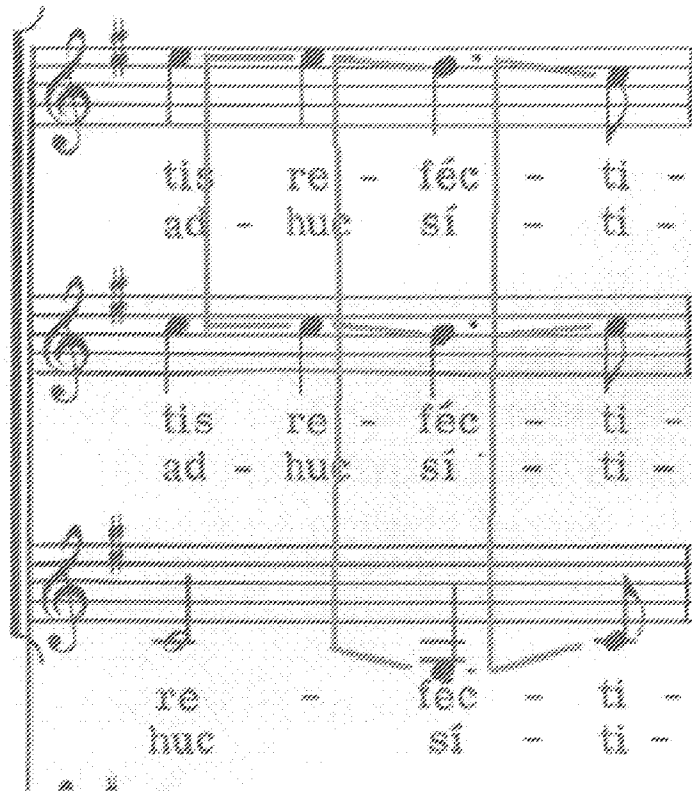
FIG. 9 illustrates a musical example referred to in a discussion of analyzing full movement combinations according to an embodiment of the present invention.

Full
Full Semitonal
Full Scalic Unbound
Full Scalic Bound
Single
Single Semitonal
Single Scalic Unbound
Single Scalic Bound
Part Dependent Single
Part Dependent Single Semitonal
Part Dependent Single Scalic Unbound
Part Dependent Single Scalic Bound A "full" is used to describe a movement combination that takes the movements of all currently changing notes into account. An example is shown with reference to FIG. 9. The diagram above shows three full movement combinations. The first takes place immediately preceding the $2^{nd}$ beat of the bar. Here, an E goes to another E in the top line and a C goes to a C in the middle line. The bottom line does not contribute to the movement combination as there is no movement at that time. The second takes place immediately preceding the $3^{rd}$ beat of the bar. Here, an E goes to a D in the top line, a C goes to a B in the middle line and a C goes to a G in the bottom line. The third takes place immediately preceding the $4.5^{th}$ beat of the bar. Here a D goes to a C in the upper part, a B goes to a C in the middle part and a G goes to a C in the bottom part.

Figure 10:
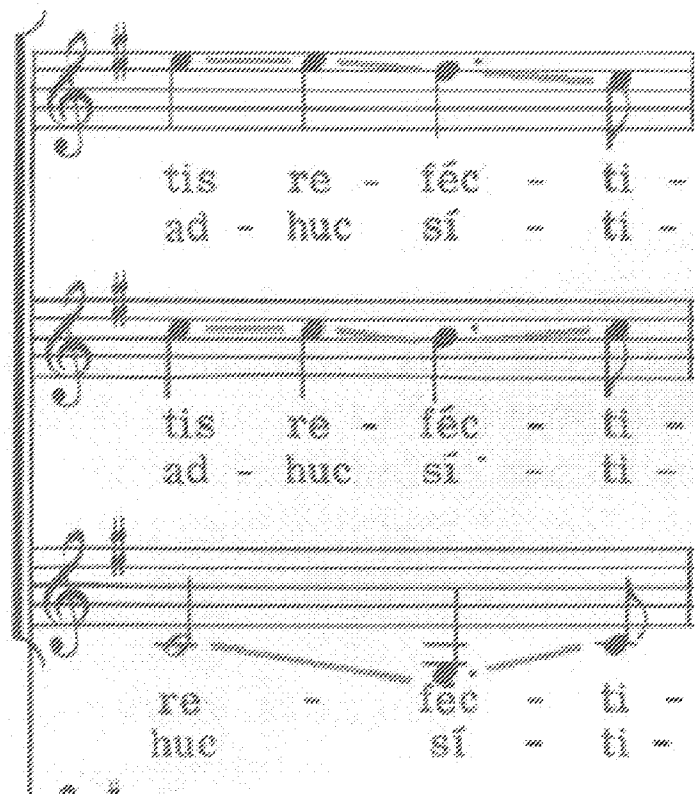
FIG. 10 illustrates a musical example referred to in a discussion of analyzing single movement combinations according to an embodiment of the present invention.

A "single" is used to describe a movement combination that only takes into account one linear movement at each time change. It describes the movement only within one line. The diagram in FIG. 10 shows eight single movement combinations. The first movement combination here takes place in the top line immediately preceding the $2^{nd}$ beat. Here an E goes to another E. The second movement combination here takes place in the top line immediately preceding the $3^{rd}$ beat. Here an E goes to a D. The third movement combination here takes place in the top line immediately preceding the $4.5^{th}$ beat. Here a D goes to a C. The fourth movement combination here takes place in the middle line immediately preceding the $2^{nd}$ beat. Here a C goes to another C. The fifth movement combination here takes place in the middle line immediately preceding the $3^{rd}$ beat. Here a C goes to a B. The sixth movement combination here takes place in the middle line immediately preceding the $4.5^{th}$ beat. Here a B goes to a C. The seventh movement combination here takes place in the bottom line immediately preceding the $3^{rd}$ beat. Here a C goes to a G. The eighth movement combination here takes place in the bottom line immediately preceding the $4.5^{th}$ beat. Here a G goes to a C.

A "part dependent single" is used to describe a movement combination that only takes into account one specific linear movement at each time change. It describes the movement only within one specified line. It differs from the single movement combination in that the line is specified. For example, a part dependent single movement combination analyzed in a soprano part cannot be used in the bass part in the recreation process. Again referring to FIG. 10, a part dependent single similar to the same eight movement combinations as described in the single movement combination section above. However, they will now all be part dependent.

Semitonal is used to describe an analysis of a movement combination that takes place on a semitonal rather than scalic basis. Using the single movement combination as shown above with reference to FIG. 10 as an example, the first movement combination listed above in the top line from E→E has a semitonal difference of 0. The second movement combination listed above in the top line from E→D has a semitonal difference of −2. The third movement combination listed above in the top line from D→C has a semitonal difference of −2.

The fourth movement combination listed above in the middle line from C→C has a semitonal difference of 0. The fifth movement combination listed above in the middle line from C→B has a semitonal difference of −1. The sixth movement combination listed above in the middle line from B→C has a semitonal difference of +1. The seventh movement combination listed above in the bottom line from C→G has a semitonal difference of −5. The eighth movement combination listed above in the bottom line from G→C has a semitonal difference of +5. Now removing duplicates, for this passage, six single semitonal movement combinations with pitch differences −5, −2, −1, 0, +1 and +5 are identified.

Scalic unbound is used to describe analysis of a movement combination that takes place on a scalic basis rather than a semitonal one and also that the scale degree is not preserved. Again, the single movement combination as shown above with reference to FIG. 10 is used as an example. As described in previous sections, the music builder may only use the Major Scale with interval separations (2,2,1,2,2,2,1) as its scalic basis. Therefore, this fragment of music will be analyzed with scale base=7 or in traditional musical terms, in G Major.

The first movement combination listed above in the top line is from E→E. In scalic terms relating to G Major, this is scale degree 6→6. The scalic difference is 0. The second movement combination listed above in the top line is from E→D. In scalic terms relating to G Major, this is scale degree 6→5. The scalic difference is −1. The third movement combination listed above in the top line is from D→C. In scalic terms relating to G Major, this is scale degree 5→4. The scalic difference is −1.

The fourth movement combination listed above in the middle line is from C→C. In scalic terms relating to G Major, this is scale degree 4→4. The scalic difference is 0. The fifth movement combination listed above in the middle line is from C→B. In scalic terms relating to G Major, this is scale degree 4→3. The scalic difference is −1. The sixth movement combination listed above in the middle line is from B→C. In scalic terms relating to G Major, this is scale degree 3→4. The scalic difference is +1.

The seventh movement combination listed above in the bottom line is from C→G. In scalic terms relating to G Major, this is scale degree 4→1. The scalic difference is −3. The eighth movement combination listed above in the bottom line is from G→C. In scalic terms relating to G Major, this is scale degree 1→4. The scalic difference is +3. Now removing duplicates, for this passage, five single scalic unbound movement combinations with pitch differences −3, −1, 0, +1 and +3 are identified.

Scalic bound is used to describe the analysis of a movement combination that takes place on a scalic basis rather than a semitonal one and also that the scale degree is preserved. It differs from scalic unbound in that the actual scale degrees on either side of the note change are preserved, not only the difference between them. Again using the single movement combination with reference to FIG. 10, here a scale base=7 or G Major is used.

The first movement combination listed above in the top line is from E→E. In scalic terms relating to G Major, this is scale degree 6→6. So the information required for this movement combination is explicitly (6 (0)) where the second number in the brackets denotes the scalic movement from the beginning scalic pitch. The second movement combination listed above in the top line is from E→D. In scalic terms relating to G Major, this is scale degree 6→5. So the information required for this movement combination is explicitly (6 (−1)) where the second number in the brackets denotes the scalic movement from the beginning scalic pitch. The third movement combination listed above in the top line is from D→C. In scalic terms relating to G Major, this is scale degree 5→4. So the information required for this movement combination is explicitly (5 (−1)) where the second number in the brackets denotes the scalic movement from the beginning scalic pitch.

The fourth movement combination listed above in the middle line is from C→C. In scalic terms relating to G Major, this is scale degree 4→4. So the information required for this movement combination is explicitly (4(0)) where the second number in the brackets denotes the scalic movement from the beginning scalic pitch. The fifth movement combination listed above in the middle line is from C→B. In scalic terms relating to G Major, this is scale degree 4→3. So the information required for this movement combination is explicitly (4(−1)) where the second number in the brackets denotes the scalic movement from the beginning scalic pitch. The sixth movement combination listed above in the middle line is from B→C. In scalic terms relating to G Major, this is scale degree 3→4. So the information required for this movement combination is explicitly (3(+1)) where the second number in the brackets denotes the scalic movement from the beginning scalic pitch.

The seventh movement combination listed above in the bottom line is from C→G. In scalic terms relating to G Major, this is scale degree 4→1. So the information required for this movement combination is explicitly (4(−3)) where the second number in the brackets denotes the scalic movement from the beginning scalic pitch. The eighth movement combination listed above in the bottom line is from G→C. In scalic terms relating to G Major, this is scale degree 1→4. So the information required for this movement combination is explicitly (1(+3)) where the second number in the brackets denotes the scalic movement from the beginning scalic pitch. There are no duplicates here therefore, for this passage eight single scalic bound movement combinations with scalic movement information (6(0)), (6(−1)), (5(−1)), (4(0)), (4(−1)), (3(+1)), (4(−3)) and (1(+3)) are identified.

Key and Chord Combination Rules

Further additional analysis may be performed to determine which chords can be connected together when generating new music. This analysis may be used to select which blocks of chord sequences may be placed adjacently in a chord block frame and in relationship to the underlying key sequence. According to one embodiment, a method for analyzing key and chord combinations includes examining a given key and chord sequence from music input (e.g., after vertical analysis) and for each chord, the available chords that can follow the chord and a difference in key at the time of the chord change are identified. A set of key and chord combination rules may be established from the examination of the given key and chord sequence.

A key and chord sequence listed in the diagram of FIG. 11 produces a traditional chord sequence of: C Major, G Major, D Minor, A Minor, C Major, G Major, A Minor, and G Major. Chord combination objects in the format of [(X){a . . . z}(1 . . . 9)] may be created for each chord where (X) represents the master chord, {a . . . z} is a list of possible following chords and (1 . . . 9) is the respective key difference per following chord. In this example, as the chord number is 1, an initial chord combination of [(null){1}(null)] may be. Next, starting on the first chord moving to the next chord, a chord change of 1→5 is identified, where the key does not change. A chord combination object of [(1)(5)(0)] is created. Next, the chord changes from 5→2 where the key does not change, creating a chord combination object of [(5)(2)(0)]. A next chord change of 2→6 where the key does not change is identified and a chord combination object of [(2)(6)(0)] is created. The next chord change of 6→1 where the key does not change produces [(6){1}(0)].

Next a chord change of 1→5 where the key does not change is identified. An existing chord combination object has already been created to reflect this change and hence does not need to be created. A next chord change of 5→2 is identified where the key changes from 0→7. The previous chord combination created with master chord=5 is updated to [(5){2,2}(0,+7)]. This indicates that chord 5 can be followed by chord 2 within the same key or chord 2 in a key +7 semitones higher.

Next, a chord change 2→1 where the key does not change is identified. The chord combination with master chord=2 is updated to [(2) {6,1}(0,0)], which indicates that chord 2 can be followed by either chord 6 or chord 1 within the same key. Finally, at the end of the sequence, it needs to be shown that chord 1 can lead to the end of the piece. The chord combination with master chord=1 is updated to [(1) {5,null}(0,null)].

Therefore, the full set of chord combinations from analysis of this example is:

[(null){1}(null)]
[(5){2,2}(0,+7)]
[(2){6,1}(0,0)]
[(6) {1}(0)]
[(1) {5,null}(0,null)]

Frame Analysis

Blocks

Blocks are subsequences of abstract data that can be used to find frames of repetition. They can also be manipulated within frames of repetition in order to create new sequences of abstract data. A list of all possible subsequences of the initial sequence (where the elements of the subsequence must be adjacent elements of the initial sequence) may be made. If the list is too large, the sequence can be split in a random or chosen place and then derive all possible subsequences from the resulting two separate lists.

For example, let an initial sequence be the numerical string, 1,2,3,4,5

Then taking all possible subsequences of this sequence produces the following:

(1), (1,2) (1,2,3) (1,2,3,4) (1,2,3,4,5)
(2), (2,3) (2,3,4) (2,3,4,5)
(3) (3,4) (3,4,5)
(4) (4,5)
(5)

Now for optimization purposes, in some situations the full initial sequence may have to be broken into smaller sequences for frame analysis. To demonstrate this, a split in the sequence is placed between numbers 3 and 4.

This is presented by the following subsequences of the two new sequences:

(1) (1,2) (1,2,3)
(2) (2,3)
(3)
(4) (4,5)
(5)

Frames

Frames may be generated from the set of blocks to provide a framework in which different blocks may be substituted to create new sequences of abstract data. Generating frames includes finding a repetition of blocks with the greatest "fitness" from a set of blocks derived from an ordered sequence of abstract data as analyzed from a music input. For example, blocks of possible subsequences may be created from an input data sequence of integers, [1,2,3,4,5,4,5,1,2,3].

In some embodiments, a "minimum block size" criterion may be desired for excluding blocks of lower sizes. In this example, a minimum block size of 2 is configured. The full set of blocks with size greater than or equal to the minimum block size will be:

{1,2} {1,2,3} {1,2,3,4} {1,2,3,4,5} {1,2,3,4,5,4} {1,2,3,4,5,4,5} {1,2,3,4,5,4,5,1} {1,2,3,4,5,4,5,1,2} {1,2,3,4,5,4,5,1,2,3}
{2,3} {2,3,4} {2,3,4,5} {2,3,4,5,4} {2,3,4,5,4,5} {2,3,4,5,4,5,1} {2,3,4,5,4,5,1,2}{2,3,4,5,4,5,1,2,3}
{3,4} {3,4,5} {3,4,5,4} {3,4,5,4,5} {3,4,5,4,5,1} {3,4,5,4,5,1,2} {3,4,5,4,5,1,2,3}
{4,5} {4,5,4} {4,5,4,5} {4,5,4,5,1} {4,5,4,5,1,2} {4,5,4,5,1,2,3}
{5,4} {5,4,5} {5,4,5,1} {5,4,5,1,2} {5,4,5,1,2,3}
{4,5} {4,5,1} {4,5,1,2} {4,5,1,2,3}
{5,1} {5,1,2} {5,1,2,3}
{1,2} {1,2,3}
{2,3}

Given the set of blocks, blocks with the highest fitness values are determined. According to one embodiment, a fitness score for a given block may be calculated by multiplying the number of times a block repeats in the set of blocks by the number of elements in the block (fitness=number of repetitions of the block*number of elements in the block). Alternatively, if the nature of the elements within the block is concerning notes, the fitness score may be calculated by the number of times a block repeats within a music piece, multiplied by the sum of lengths of all notes in the block. Another criterion to consider may be a minimum number of repetitions of a block. A block that represents the whole sequence may have the highest fitness score, according to the fitness formula, but does not repeat. Therefore, blocks with the highest fitness values that do not have the minimum number of repetitions may be disqualified.

The length of an input sequence may be used as a basis for generating the frame. Given the input sequence of 1,2,3,4,5, 4,5,1,2,3 is composed of 10 elements, an initial sequence of 10 empty element slots, X,X,X,X,X,X,X,X,X,X may serve as the basis of a frame. From the full set of blocks generated from the input sequence, an initial block of highest fitness, {1,2,3} with a fitness score of 6 (the block repeating twice (2) multiplied by the 3 elements in the block) may be selected. A common identifier, e.g., "A" may be associated with the elements of the initial block. The identifier may be assigned and populated to positions in the frame corresponding to the positions of the elements in the initial block in the original input sequence. In this example, the frame will become {A,A,A}X, X,X,X {A,A,A}.

Additional blocks of highest fitness may continue to be selected if it is determined that the frame allows for further repetitions in the remaining slots of the frame. Remaining (unassigned) slots may be populated with blocks until all slots of size greater than the minimum block size have been assigned or are unable to be assigned. In the current example, the frame allows for further block repetition. No blocks that overlap with already assigned time slots may be selected. Any blocks that overlap with already assigned slots are excluded. The available blocks for analysis are reduced to:

{4,5} {4,5,4} {4,5,4,5}
{5,4} {5,4,5}
{4,5}

As only blocks that repeat at least once are considered, from the reduced set of blocks, the block of highest fitness is (4,5) with a fitness of 4 as there are two instances of it and the size of the block is 2. Therefore, the final frame generated by the analysis will be:

{A,A,A} {B,B} {B,B} {A,A,A}

In the examples above, all the elements of the sequence are shown as having equal units of time, however, actual data sequences may include time dependent elements of varying lengths. Each of the elements in block A and block B may not be the same length as those in subsequent repeated blocks.

Forked Analysis

Suppose an input sequence is 1,2,3,1,2,3,4,3,4,1,2,3. In performing frame analysis according to the steps described above, the block with the highest fitness will be {1,2,3} with a fitness of (3*3)=9. Using this block will produce a final frame of {A,A,A}{A,A,A}X,X,X{A,A,A}. However, for example, if block {1,2} with the next highest fitness (2*3=6) was instead chosen as the initial block, then an initial frame of {A,A}X{A,A}X,X,X,X{A,A}X would be produced. The remaining empty frame spaces allows for another block of {3,4} to be populated in the empty spaces, producing a final frame of {A,A}X{A,A}{B,B}{B,B}{A,A}X.

One can see here that the final frame generated using a block with the second highest fitness would actually result in more empty spaces in the frame being assigned. Similarly, in situations when multiple highest fitness exists for more than one block, selecting one randomly will not always ensure that the empty frame will be filled to its full potential. Therefore, additional frames of varying block fitness scores may be analyzed to generate fuller frames. According to one embodiment, multiple frames may be created using blocks of different fitness scores and then compared to determine frames that have been filled to their full potential.

In the example given above, with sequence 1,2,3,1,2,3,4, 3,4,1,2,3, at each step, all frames within an allowed fitness deviation of −3 from the highest fitness score may be generated. In addition to the block {1,2,3} with the highest fitness of 9, frames for blocks {1,2} and {2,3} with fitness of 6 may also be generated. The following three frames are generated:

{A,A}X{A,A}X,X,X,X {A,A}X generated by {1,2}

X{A,A}X{A,A},X,X,X,X{A,A}generated by {2,3}

{A,A,A}{A,A,A}X,X,X {A,A,A}generated by {1,2,3}

After a second iteration of populating the frames with blocks, the following final frames are produced:

{A,A}X{A,A}{B,B}{B,B}{A,A}X generated by {1,2} and {3,4}

X {A,A}X {A,A}X,X,X,X{A,A} generated by {2,3}

{A,A,A}{A,A,A,A}X,X,X{A,A,A} generated by {1,2,3}

After the final frames are determined, a comparison of their full fitness can be determined by counting the number of assigned elements (or empty frame spaces) in the sequence. In this example, the three frames have full fitness scores of 10, 6 and 9 for the first, second and third frames, respectively. From the full fitness scores, it is determined that the first frame has been filled out to the greatest potential of the three.

Generating Sequences of Abstract Data Using Frames and Blocks

In the previous sections, analyzing sequences of abstract data (e.g., keys, chords, rhythm, movement patterns, harmony) from input music have been described. Methods to find blocks (subsequences) and frames of repetition from these sequences of abstract data have also been described. This section now describes how new sequences of abstract data may be recreated using these frames and blocks.

Alternate subsequences or blocks of musical data can be substituted into the frame slots and joined together according to rules derived from the order in which the original subsequences were arranged (e.g., combination rules) to create a new sequence of musical data. In one embodiment, block combination rules (e.g., key and chord combination rules) may be used to find suitably matching subsequences to put together. For example, a plurality of various blocks may be created and a combination of the various blocks which produces the least transgressions when combined together according to the block combination rules may be selected to generate the new sequence of abstract data. Finding arrangements of blocks in frames that have minimum transgression of combination rules may be very computationally expensive. According to one embodiment, the music builder may use multi-objective genetic algorithms to aid in finding optimal arrangements of blocks within the frames. The new sequences of abstract data created may then be used in the process of composing new music.

Using Part Independent Frames

Part independent frames provide a framework of repetition for abstract data structures that are not dependent on the arrangement of musical parts within the piece. Examples are key and chord sequences. An example of a part independent frame is {[AA][BBB][AA]}. This describes that a block of size 2 is placed twice into the sequence and a block of size 3 is placed once into the sequence. The following blocks of integer sequences is given:

{1,2}
{2,1}
{3,1}
{4,5,5}
{1,2,4}

These may be analogous to part independent abstract data types e.g., key and chord sequences. A block of size 2 may be selected at random. For example, block {2,1} is selected and is inserted into the 'A' slots in the frame. The updated frame is now {[2,1][B,B,B][2,1]}. Then a block of size 3 is selected at random. Block {4,5,5,} may be selected. The updated frame may then become {[2,1,][4,5,5][2,1]}. As such, a new sequence of {2,1,4,5,5,2,1} may be generated using this process. Combination rules can be applied at the "joints" between the blocks to test for fitness. The joints of {1->4} and {5->2} may be tested. This process is analogous to generating a new sequence of part independent abstract data using a part independent frame and blocks derived from the previous analysis.

Part Independent Key and Chord Blocks and Frames

The above discussion of blocks and frames is applied to key and chord sequences. According to one embodiment, key sequences may be generated as described in the discussion above. However, generating blocks from a chord sequence includes generating blocks of chords within the boundaries of a corresponding key sequence. A full set of chord blocks may be generated within the boundaries of the underlying keys. For example, a full set of chord frames may be generated from sequences bounded by the keys in a manner as shown by the line between keys 0 and 7 in FIG. 12. The resulting full set of blocks derived from the key and chord sequence of FIG. 12 according to the boundary set between the keys may be:

{1} {1,5} {1,5,4} {1,5,4,5} {1,5,4,5,1}
{5} {5,4} {5,4,5} {5,4,5,1}
{4} {4,5} {4,5,1}
{5} {5,1}
{1}
{5} {5,4} {5,4,5}
{4} {4,5}
{5}

Chord sequences should exist independently of the keys that lie beneath them. This prevents the chord sequence from being bound to the key of a piece. A representation of a chord sequence frame from the chord and key sequence pair example above is shown in FIG. 13, where the repetitions of the blocks in the frames are generated independent of the underlying keys. Key and chord sequences may be generated using frames and blocks, ensuring that adjacently placed blocks cause as few transgressions of the key and chord combination rules as possible. These combination rules were described earlier in this document and describe which keys and chordal movements are allowable due to the information gained from the analysis of the original input piece.

Using Part Dependent Frames

Part dependent frames may also be used to create sequences of abstract data. Examples of data structures that require part dependent frames are rhythm, movement pattern and harmony. Part dependent frames allow preservation and creation of contrapuntal patterns in music for musical interplay between different musical parts. Part dependent frames for harmony, movement pattern, and rhythm are all generated in a similar manner. An example of a diagrammatical representation of a time dependent, part independent frame for a movement pattern sequence is illustrated in FIG. 14, where the letters denote assigned blocks and the "X"s denote unassigned elements.

Suppose the following blocks are generated for the movement pattern:

{1}

{1,2}{2,1}

{1,2,3}{1,3,2}{2,1,3}{2,3,1}{3,1,2}{3,2,1}

Figure 17:
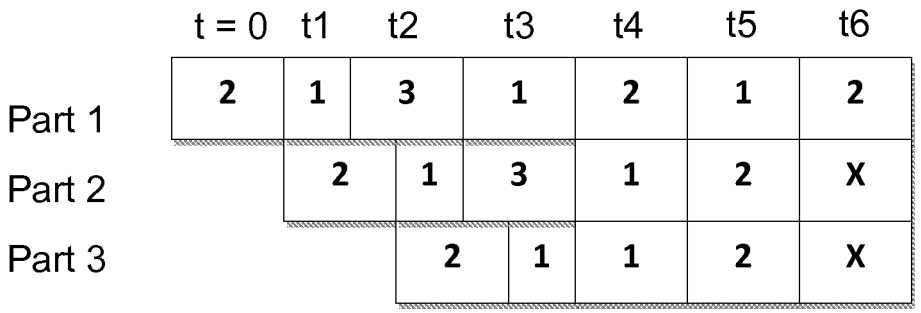
Figure 18:
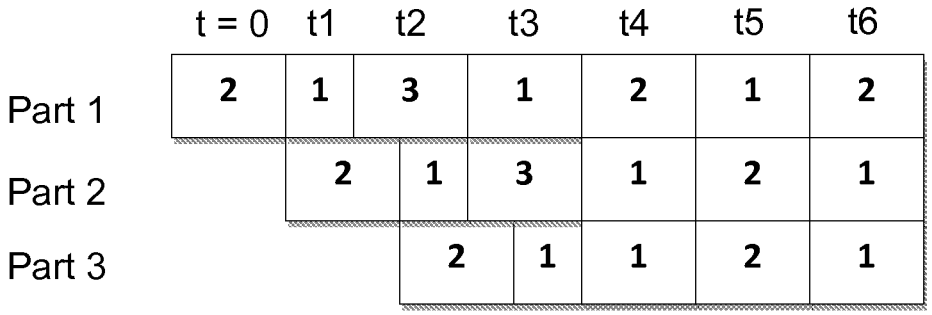

The illustrated movement pattern frame includes three parts (or lines) and is assigned varying time dependent slots. For slot A, a two element block may be randomly selected to be {2,1} and the frame representation is shown in FIG. 15. Due to the nature of a movement pattern, the numbers have meaning when in context with the other movement pattern numbers of their block. For slot B, a block which contains three elements is needed. The block {3,1,2} may be chosen and updates the frame as shown by FIG. 16. For slot C, a two-element movement pattern block of {1,2} may be selected, FIG. 17. Finally, the X slots are filled. As the movement pattern only has one one-element block, {1} is selected, and the final movement pattern sequence is shown in FIG. 18.

Harmony Combination Rules with Part Dependent Frames and Blocks

In creating new harmony sequences, some rules may be applied when concerning the harmony structure to ensure that non-harmony elements are not placed adjacently within the same lines as this would contravene the rules in chordal analysis. For example, according to the chord analysis algorithm, an inessential fragment must lie adjacent to an essential fragment within its line. Therefore, harmony combination rules may be employed to ensure that this is always the case in the newly generated harmony sequence.

Generating Music Using Possible Pitch Reduction and Pitch Locking

The new sequences of abstract data that have been generated may now be used to compose new music. As a starting point, the rhythm sequence that was generated in the part dependent section of the abstract data generation is selected.

Population

Figures 19, 20:
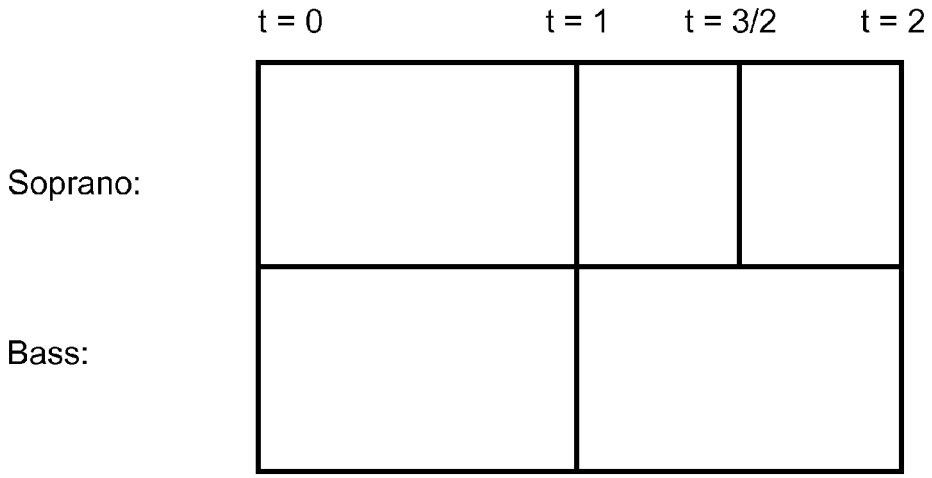
FIG. 19 illustrates a pitch-empty rhythm structure of a new music piece according to an embodiment of the present invention.
FIG. 20 illustrates a rhythm structure storing a list of possible pitches according to an embodiment of the present invention.

Composing new music may include determining suitable possible pitches for each note in a new rhythm sequence. A pitch-empty rhythm structure of a new music piece with two parts consisting of two notes in the lower part (bass) and three notes in the upper part (soprano) is illustrated in FIG. 19. Each note slot in the rhythm sequence may initially be populated with a full semitonal set of possible pitches. The set of possible pitches may include a set of every semitone that lies between the lower and upper bounds of the range of the parts (or lines) within which the note lies, inclusive. For example, the range of notes for the soprano part may be 48-60, corresponding to the alphabetic notation of {C,C#,D,D#,E,F,F#,G,G#,A,A#,B,C}, and the part for the bass may range from notes 24-36, corresponding to {C,C#,D,D#,E,F,F#,G,G#,A,A#,B,C}. The full list of possible pitches for the two parts may be stored in the rhythm structure as shown in FIG. 20.

Chord and Harmony Reduction

Figure 21:
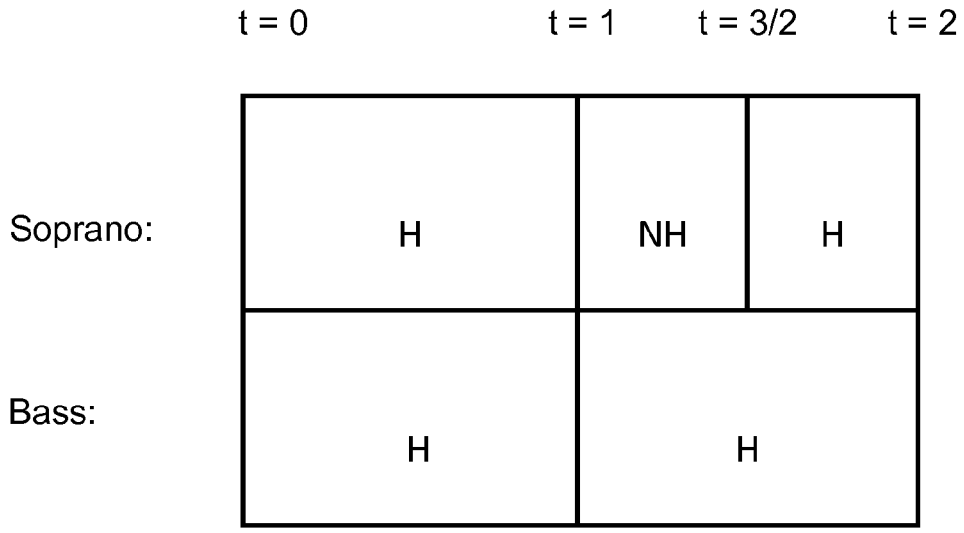

The full set of possible pitches for each note may be reduced by discarding pitches that do not conform to the corresponding new generated key and chord sequence. According to one embodiment, a chord and harmony reduction may be performed on the possible pitches. Each note in the exemplary rhythm sequence may have associated harmony values from its corresponding generated harmony sequence of either harmony (H) or non-harmony (NH) note fragments. FIG. 21 presents harmony values dictated by a harmony sequence associated with the above rhythm sequence. The pitches in the rhythm sequence structure may be reduced based on the harmony values from the harmony sequence.

Figure 22:
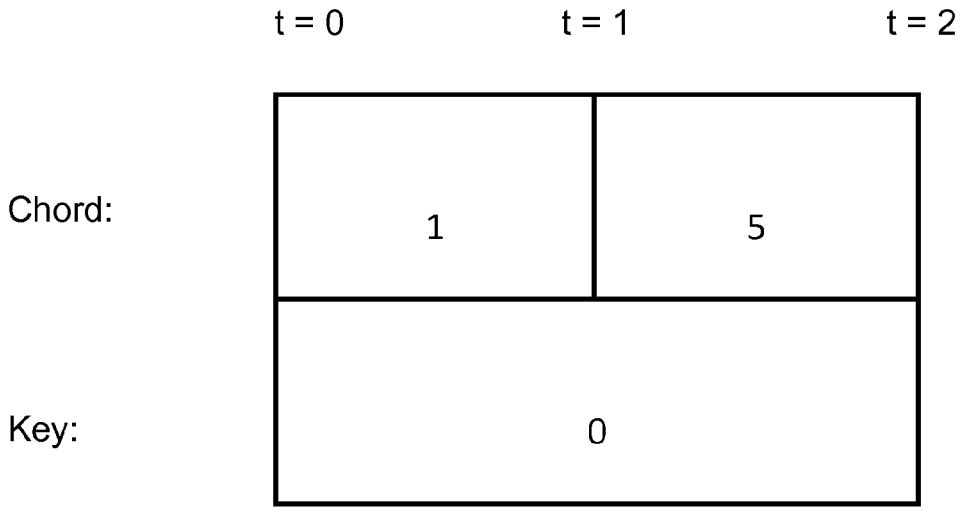

In addition, FIG. 22 shows an exemplary key and chord sequence corresponding to the rhythm structure. A highest chordal number of a fifth may be selected for the chords in this particular example (7th or 9th chords etc. are not considered). The chord harmony scalic pitches (or triad) of {1,3,5}, representing the first, third, and fifth notes, may be established as pitches that are located on a chord that are used as a basis in pitch reduction. For example, the C Major scale consists of the notes C, D, E, F, G, A, B, and a triad of the C Major chord consists of the C, E, and G notes.

The possible pitches for harmony notes or notes with an H in the rhythm sequence structure of FIG. 21 may be reduced by the chord in which they lie. A slot in the harmony sequence for the soprano part from t=0 to t=1 is a harmony note. The value of H indicates that the note lies within the assigned chord. The note corresponds to a key of 0 and a chord of 1 from the key and chord sequence. In this example, chord 1 in the key of 0(C Major) is C Major. As discussed above, the triad for the chord of C Major includes the notes of C, E, and G. Possible pitches that do not lie in the triad of C Major may be discarded. Therefore, the pitches in the soprano part between t=0 and t=1 may be reduced to 48 (C), 52 (E), 55 (G), and 60 (C) as shown in FIG. 23. Similarly, the next harmony note from t=3/2 to t=2 in the soprano part has a key of 0 and a chord of 5. A chord of 5 in the key of O(C Major) indicates that pitches that do not lie within the triad of G Major may be discarded. As such, the possible pitches for the soprano part from t=3/2 to t=2 are reduced to 50(D), 55(G), and 59(B).

The bottom (bass) part of the same rhythm sequence of FIG. 21 between t=0 and t=1 is associated with a key of 0, chord of 1, and is a harmony note. The chord indicates that the possible pitches lie within the chord of C Major and the possible bass pitches are updated to 24(C), 28(E), 31(G), and 36(C), illustrated in FIG. 24. The next bass note from t=1 to t=2 has a key of 0, chord of 5 and is a harmony note. Therefore, the possible pitches lie within the chord of G Major and the reduction of the possible pitches is updated to 26(D), 31(G), and 35(B).

The note in the soprano part between t=1 to t=3/2 is a non-harmony note and may be reduced by analyzing non-harmony information and rules discussed above in the harmony analysis section. From the previous discussion, the process of harmony analysis may establish certain criteria for allowed non-harmony movements including the previous scale number in the line, the current scale number in the line, the next scale number in the line, the previous chord, the current chord, the next chord, the previous key, the current key, the next key, and the set of other sounding scalic numbers. The above information in the criteria is determined for each of the possible pitches in the non-harmony note (e.g., t=1 to t=3/2 in the soprano part) and is compared with a set of allowed non harmony criteria. Each possible pitch that does not match all or at least a portion of the allowed non-harmony criteria may be discarded from the list of possible notes for the non-harmony note.

For example, from harmony analysis, the following information is derived which can then be used as a guideline to find an acceptable non-harmony pitch in the non-harmony note of the soprano part between t=1 to t=3/2:

Previous scale number=1.

The current scale number in the line=1.

The next scale number in the line=7 (falling from 1).

The previous chord=1.

The current chord=5.

The next chord=5.

The previous key=0.

The current key=0.

The next key=0.

The set of other sounding scalic numbers=5.

In this example, the scale numbers are listed in cyclic form without preserving octave information for ease of the explanation of the core concepts. However, actual practice allows for octave information to be preserved within the non harmony structure whilst allowing the structure as whole to be transposed to different octaves. For this example, assume that the pitch of the previous scale number (1) is equal to the pitch of the current scale number in the line (1) which is one semitone higher than the next scale number in the line (7) and not any other octave multiple.

The list of possible pitches for the non-harmony note is examined to determine which of the possible pitches can meet these non harmony criteria. It may be determined that the 60(C) note has the following information:

Previous scale number=1.

The current scale number in the line=1.

The next scale number in the line=7.

The previous chord=1.

The current chord=5.

The next chord=5.

The previous key=0.

The current key=0.

The next key=0.

The set of other sounding scalic numbers={2,5,7}. {2,5, 7}contains 5 so this criteria is passed.

Therefore, 60(C) can be a possible non-harmony pitch. However, it may be determined that this is the only pitch that is possible for the rhythm sequence. Pitches between 49 and 59 fail as none of these semitones are equal to scalic pitch 1 in C Major (i.e. 'C') Pitch 48 fails on the "next scale number in the line condition" as the current scale number (1) will need to fall one semitone to the next scale number (7). However, there is no pitch 47 available in the next harmony note in the rhythm sequence and therefore, this criteria is not met. Therefore, in this example, 60(C) is the only possible pitch. The possible pitches reduced by chord and harmony reduction are illustrated in FIG. 25.

In this example, the possible non-harmony pitch has been chosen based on the assumptions that the previous scale number was 1, the pitch 60 will fall to the successive 59 in the soprano part, and the simultaneously sounding bass note is scalic pitch 5. In a final reduction, the possible pitches of these related notes may be respectively further reduced to ensure that they do not transgress the non-harmony information listed above. The final set of chord and harmony reduced possible pitches is illustrated in FIG. 26.

Movement Pattern Reduction

Pitches may have to be limited to fit in line with the newly generated sequence of movement pattern information as described in the part dependent, abstract data generation section. This brings into question another remaining theoretical problem which is the balancing of rule transgressions of various components in the recreation stage. Accordingly, one or more non-harmony rules may be transgressed in movement pattern reduction. It may be the case that after chord and harmony reduction, as in this example, all the soprano pitches would already be definite (finally reduced such that there is only one possible pitch to select for each note), leaving no further notes for movement pattern reduction.

Figure 27:
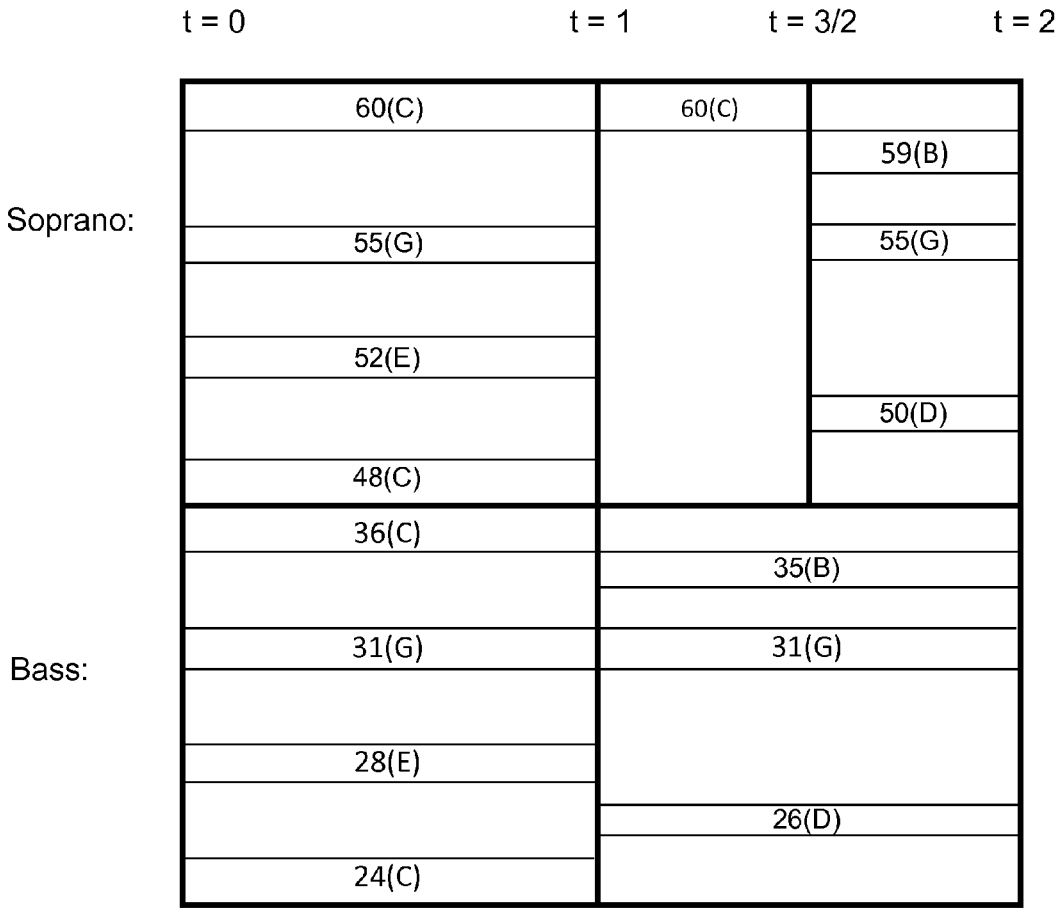
FIG. 27 and FIG. 28 illustrate movement pattern reduction of possible pitches within a rhythm structure according to an embodiment of the present invention.

As such, an alternative embodiment may include the introduction of a higher level, multi-objective balancing that can control the various possible pitch reduction modules to ensure that best combinations of reduction may be chosen at each stage. Alternatively, in cases such that the possible pitches are pitchlocked (described in a later section) and can work harmoniously with each other (e.g., when using a pentatonic scale base), chord and harmony pitch reduction may be bypassed. For the purposes of describing movement pattern reduction, FIG. 27 is an alternative visual representation of the rhythm sequence structure in FIG. 25. The pitches here represent the possible pitches of the notes in their states before the final reduction by the chord and harmony reduction module.

Figure 28:
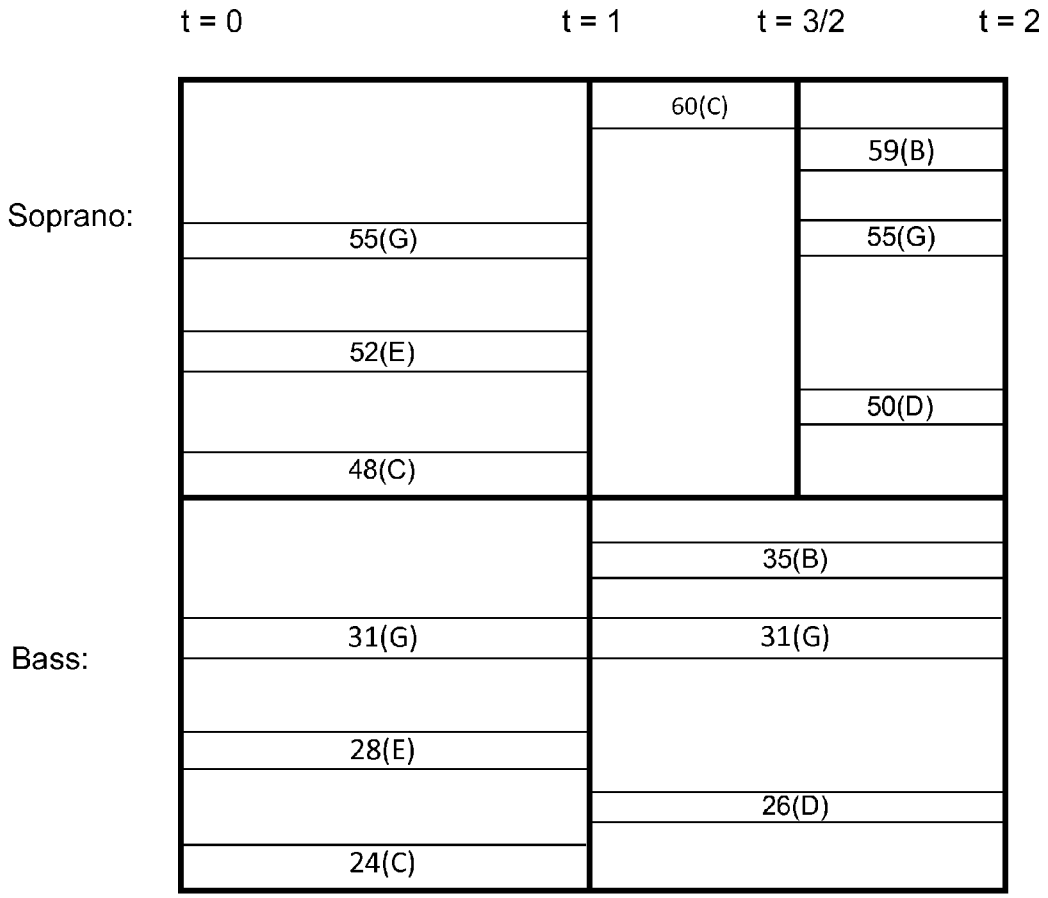

In this example, suppose an allowed movement pattern from a recorded soprano part is {3,1,2}. The movement pattern may specify that the pitch of the first note must be lower than the pitch of the third note which, in turn, must be lower than the pitch of the second note. The only possible pitch which currently explicitly transgresses this rule is the 60(C) in the first note between t=0 and t=1, as it is not lower than any possible pitches in the second or third notes. Therefore, the 60(C) pitch is removed from the first note of the soprano and the movement pattern reduces the possible pitches for the soprano part, as shown in FIG. 28. The bass part may consider a recorded movement pattern of {2, 1}. The movement pattern specifies that the first note must have a lower pitch than the second note. The only pitch that explicitly transgresses this rule is the 36(C) of the first note in the bass part (t=0 to t=1) as there are no possible pitches higher than it in the second note. As such, the movement pattern reduced bass possible pitches are illustrated in FIG. 28.

Selecting Pitches

After reducing the possible pitches for each note, the movement combination rules described earlier in the horizontal analysis section may be used to guide the decision in choosing these pitches for music composition. For each start time of a note or notes, the possible pitches in the relevant notes are analyzed according to the following hierarchy of movement combinations, stopping when one of these combinations is satisfied by the available possible pitches. The hierarchy is as follows:

Full Scalic Bound Movement Combination

Full Semitonal Movement Combination

Full Scalic Unbound Movement Combination

Part Dependent Single Scalic Bound Movement Combination

Part Dependent Single Semitonal Movement Combination

Part Dependent Single Scalic Unbound Movement Combination

Single Scalic Bound Movement Combination

Single Semitonal Movement Combination

Single Scalic Unbound Movement Combination

Exit Clause 1: Where a pitch is selected randomly from the possible pitches when no suitable movement combination is found.

Exit Clause 2: Generate a chordal pitch when there are no possible pitches for one or more notes.

Figure 29:
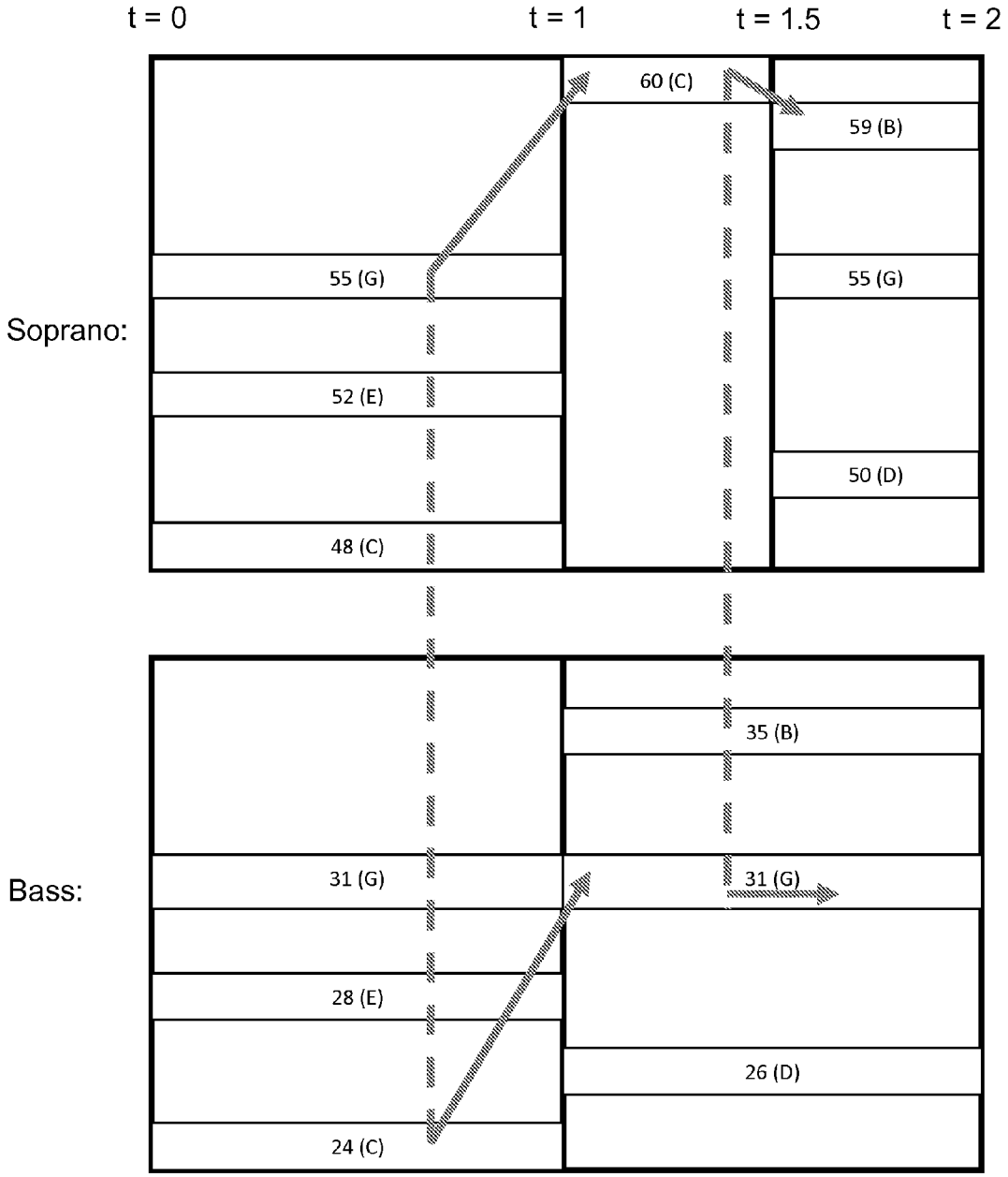
FIG. 29 illustrates a diagram of using movement combination information to select pitches from possible pitches within a rhythm structure for a full movement combination.

FIG. 29 presents a diagram of using movement combination information to select pitches from a reduced set of possible pitches in a rhythm structure for using full movement combinations. In the exemplary diagram of FIG. 29, possible pitches in their state of having been reduced by movement pattern rules. The arrows in FIG. 29 represent possible movement combinations resulting from analysis. Two note start times, t=1 and t=1.5 are examined in this example. At t=1, the first full movement combination dictates that the soprano and bass move upwards in the fashion shown by the arrows from t=0 to t=1.

Using this movement combination from the analysis, pitches 55 and 60 may be selected in the soprano part and pitches 24 and 31 may be selected in the bass part on either side of the time divide. If the movement combination is full scalic bound, it would dictate a movement from scalic pitch 5 to scalic pitch 1 in the relevant direction in the soprano part and a movement from scalic pitch 1 to scalic pitch 5 in the relevant direction in the bass part. If the movement combination is full semitonal, it would dictate a movement of +5 semitones in the soprano part and +7 semitones in the bass part. If the movement combination is full scalic unbound, it would dictate a movement of +3 scalic pitches in the soprano part and +4 scalic pitches in the bass part. In all of these full movement combinations, the bass pitches would be a definite number of semitones or scalic pitches lower than the pitches in the soprano part. If any of these movement combinations are available, then the possible pitches would fit into the rules dictated and allows selection of these pitches on either side of the time divide as definite.

In the next examined time of t=1.5, the second full movement combination in the example dictates that the soprano pitch falls as shown and that there is an unmoving held pitch (not just two notes with the same pitch but one note whose length crosses the time divide). If a movement combination of this nature is identified from analysis, then the pitches in the soprano part on either side of the t=1.5 time divide may be set as 60(C) and 59(B). If the movement combination is full scalic bound, it would dictate a movement from scalic pitch 1 to scalic pitch 7 in the relevant direction of the soprano part and would dictate a held note on scalic pitch=5 at the relevant octave difference. If the movement combination is full semitonal, it would dictate a movement of −1 in the soprano part and a held set pitch in the bass part, 29 semitones lower than the soprano pitch of 60(C) at t=1. If the movement combination is full scalic unbound, it would dictate a movement of −1 in the soprano part and a held pitch. Again, in all of these full movement combinations, the bass pitches would be a definite number of semitones or scalic pitches lower than the pitches in the soprano part. If any of these movement combinations are available, then the possible pitches would fit into the rules dictated and these pitches on either side of the time divide may be selected as definite.

Figure 30:
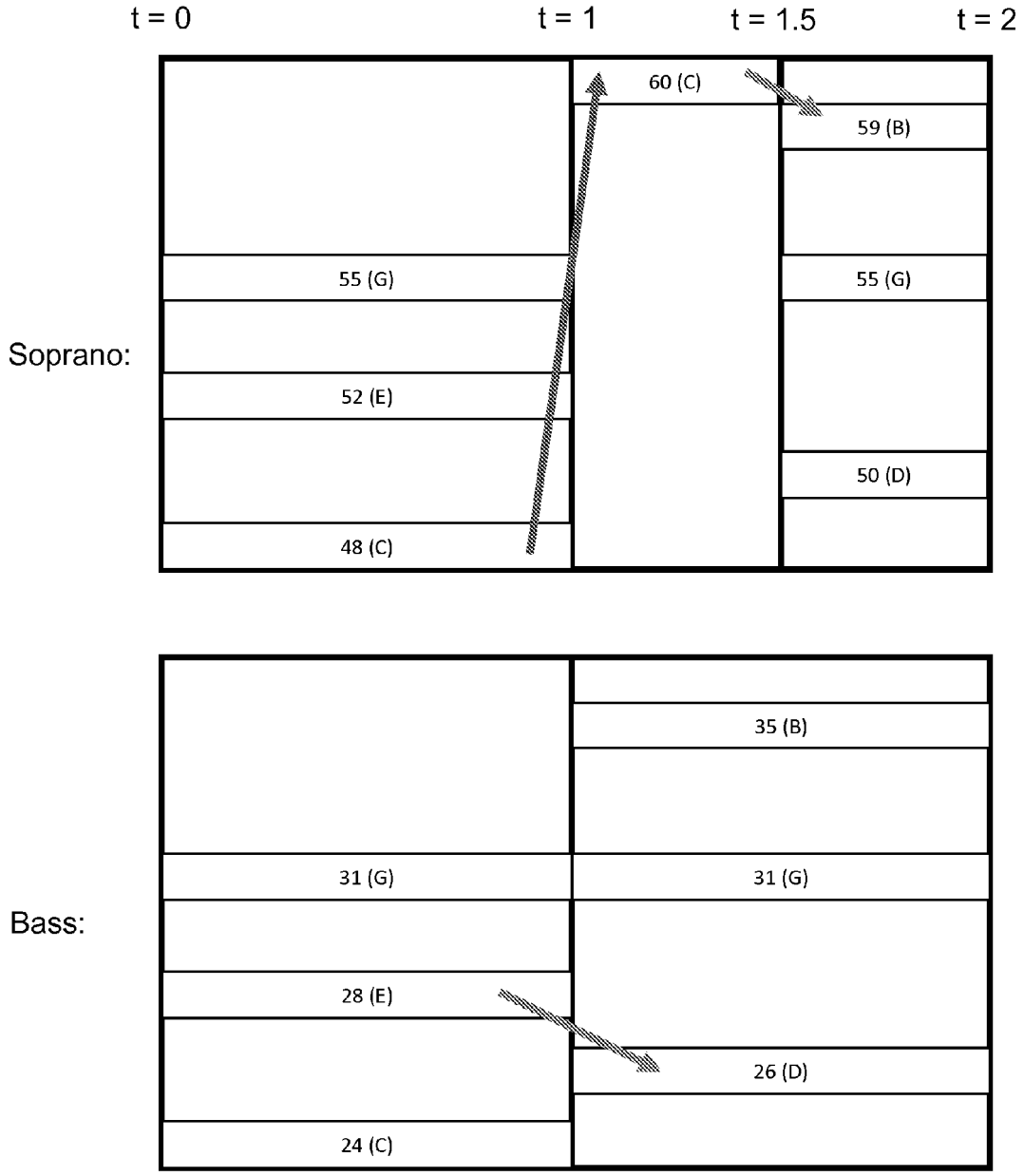
FIG. 30 illustrates a diagram of using movement combination information to select pitches from possible pitches within a rhythm structure for a series of single movement combinations.

FIG. 30 presents a diagram of using movement combination information to select pitches from a reduced set of pitches in a rhythm structure for a series of single movement combinations. In this example, the first arrow in the soprano part represents a movement combination that is a part dependent, single movement combination for these possible pitches. As such, this movement combination had come from part 1 of 2 in the analysis.

Again, times t=1 and t=1.5 are examined in this example. At t=1, the movement combination in the soprano part dictates that the pitch moves upwards as the first arrow in the soprano part shows. If a movement combination of this nature is identified from analysis then pitches 48 and 60 from either side of the time divide for the soprano part may be selected. If the movement combination is scalic bound, it would dictate a movement from scalic pitch 1 to scalic pitch 1 with the difference of an octave in an upwards direction. If the movement combination is semitonal, it would dictate a movement of +12 semitones. If the movement combination is scalic unbound, it would dictate a movement of +7 scalic pitches.

The movement combination in the bass part dictates a downward pitch movement. If a movement combination of this nature is identified from analysis, then the pitches 28 and 26 on either side of the time divide for the bass part may be selected. If the movement combination is scalic bound, it would dictate a movement from scalic pitch 3 to scalic pitch 2 with the scalic interval difference of −1 in a downwards direction. If the movement combination is semitonal, it would dictate a movement of −2 semitones. If the movement combination is scalic unbound, it would dictate a movement of −1 scalic pitches.

In the next examined time of t=1.5, the movement combination in the soprano part dictates that the pitch moves downwards as the arrow shows. If a movement combination of this nature is identified from analysis, then the pitches 60 and 59 from either side of the time divide for the soprano part may be selected. If the movement combination is scalic bound, it would dictate a movement from scalic pitch 1-->scalic pitch 7 with the scalic interval difference of −1 in a downwards direction. If the movement combination is semitonal, it would dictate a movement in a downwards direction of −1 semitones. If the movement combination is scalic bound, it would dictate a downwards movement of −1 scalic pitches.

Exit clause 1 may be used when no movement combination is available to guide the part writing for a particular time. In this case, a random selection from the possible pitches may be made for all notes sounding at this particular time. There may also be situations where there are no available possible pitches for a note after pitch reduction (e.g., due to over-aggressive pitch reduction). In this situation, exit clause 2 may be employed and a chordal pitch may be generated regardless of whether the note is a harmony note of a non-harmony note. The chordal pitch may be determined based on the chord in which the note lies. In conjunction with this process, an arbitrary movement combination may also be selected to help guide the music builder to a pitch. When all the pitches have been chosen using the above movement combination hierarchy, the resulting notes selected may produce a new music composition.

Determining Fitness of Composition

The movement combination hierarchy listed above may also be used to assess the fitness of the final notes of a new composition. The order of hierarchy of the combination movement rules may correspond to the degree of fitness of the new music composition. For example, start times with notes whose pitches can be generated by movement combination rules higher up on the hierarchy may generally have higher fitness as they will be more closely related to the style of the original music input piece(s). If the pitches of a new composition are entirely dictated by a Full Scalic Bound movement combination, it is highly likely that the part writing would be very similar to the original music input piece(s). However, if Exit Clause 1 was used to generate the majority of the pitches of a music composition, it is likely that the part writing of the output piece would be much less similar to that of its music input counterpart(s). Another area in which one can measure the fitness of the composition is in the number of transgressions of combination rules that occurred during the creation of sequences of abstract data earlier in the process. For example, a chord sequence that is constructed of chord blocks (subsequences) being arranged in a way which gives rise to chords placed adjacently in a manner that was not described in the original input piece(s) is likely to have a lesser fitness than one in which the chord blocks are arranged in such a way that all adjacent chordal movements have been described in the original input piece(s).

Pitch Locking

There are some scalic "modes" that are arguably not actually modes in themselves but are rather just a subset of another mode. An example of this is the penatatonic scale. This can be formed by simply removing some pitches of a major scale. To allow for scalic modes such as this, the possible pitches of the population stage are locked or bounded to the scalic mode required. For example, the music builder may use only the semitonal or scalic pitches of the music input pieces in the output. The music builder may either detect or receive a user selection to operate in a limited scalic mode to limit the pitches available in the population stage to match the limited scale.

FIGS. 1 through 30 are conceptual illustrations allowing for an explanation of the present invention. It should be understood that various aspects of the embodiments of the present invention could be implemented in hardware, firmware, software, or combinations thereof. In such embodiments, the various components and/or steps would be implemented in hardware, firmware, and/or software to perform the functions of the present invention. That is, the same piece of hardware, firmware, or module of software could perform one or more of the illustrated blocks (e.g., components or steps).

In software implementations, computer software (e.g., programs or other instructions) and/or data is stored on a machine readable medium as part of a computer program product, and is loaded into a computer system or other device or machine via a removable storage drive, hard drive, or communications interface. Computer programs (also called computer control logic or computer readable program code) are stored in a main and/or secondary memory, and executed by one or more processors (controllers, or the like) to cause the one or more processors to perform the functions of the invention as described herein. In this document, the terms "machine readable medium," "computer program medium" and "computer usable medium" are used to generally refer to media such as a random access memory (RAM); a read only memory (ROM); a removable storage unit (e.g., a magnetic or optical disc, flash memory device, or the like); a hard disk; or the like.

Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

The invention claimed is:

1. A method for analyzing frames and music data blocks of musical data, the method comprising:

receiving, via a processing device, music input data;

extracting, via the processing device, an initial sequence of data from the music input data;

generating, via the processing device, a plurality of music data blocks from the initial sequence of data;

calculating, via the processing device, fitness scores for the plurality of music data blocks;

determining, via the processing device, one or more of the plurality of music data blocks with the highest fitness scores;

populating, via the processing device, slots of one or more sequence frames with placeholders that represent the one or more music data blocks with the highest fitness scores; and generating, via the processing device, one or more key, chord, harmony, rhythm and movement pattern sequences based on the one or more sequence frames.

2. The method of claim 1 wherein the one or more music data blocks are subsequences of musical data of the initial sequence of data.

3. The method of claim 1 wherein populating the one or more slots of a sequence frame further comprises:

detecting a repetition of the one or more music data blocks; and assigning the repetition of the one or more music data blocks a fitness score.

4. The method of claim 1 wherein the fitness scores are calculated by multiplying a number of times a given music data block repeats in the plurality of music data blocks by a number of elements in the given music data block.

5. The method of claim 1 wherein the fitness scores are calculated by multiplying a number of times a given music data block repeats within a music piece by a sum of lengths of notes in the given music data block.

6. The method of claim 1 wherein determining one or more music data blocks with the highest fitness scores further comprises determining a minimum number of repetitions of the one or more music data blocks.

7. The method of claim 1 wherein the one or more music data blocks are populated into the one or more slots of the sequence frames based on music data block combination rules to find suitably matching music data blocks to put together.

8. The method of claim 1 further comprising:

upon insertion of a block into a frame slot, inserting the block into corresponding slots which share the placeholder based on a repetition of the one or more music data blocks and populating remaining slots of the one or more sequence frames with additional music data blocks with the highest fitness scores.

9. The method of claim 8 wherein the remaining slots are populated with music data blocks until all slots of size greater than a minimum music data block size have been used.

10. The method of claim 8 wherein music data blocks that overlap with already populated slots are not used to populate the remaining slots.

11. The method of claim 1 wherein adjacently populated key and chord music data blocks are ensured to cause as few transgressions according to key and chord combination rules.

12. The method of claim 1 wherein populating one or more sequence frames further comprises substituting alternative music data blocks of musical data into the one or more sequence frames according to rules derived from an order in which the one or more populated music data blocks were arranged.

13. The method of claim 1 further comprising determining optimal arrangements of the one or more music data blocks within the one or more sequence frames using multi-objective genetic algorithms.

14. The method of claim 1 further comprising composing new music using the one or more generated key and chord sequences.

15. The method of claim 1 wherein populating slots of one or more sequence frames further comprises:

simultaneously populating a plurality of sequence frames with blocks that are of optimal fitness; and selecting a best populated of the plurality of sequence frames.

* * * * *